US008616929B2

(12) United States Patent
Kawaguchi

(10) Patent No.: US 8,616,929 B2
(45) Date of Patent: Dec. 31, 2013

(54) VESSEL PROPULSION APPARATUS

(75) Inventor: Shintarou Kawaguchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/402,246

(22) Filed: Feb. 22, 2012

(65) Prior Publication Data

US 2012/0231683 A1 Sep. 13, 2012

(30) Foreign Application Priority Data

Mar. 9, 2011 (JP) ..... 2011-051668

(51) Int. Cl.
*B63H 20/14* (2006.01)

(52) U.S. Cl.
USPC ..... 440/75; 440/88 R

(58) Field of Classification Search
USPC ..... 440/75, 89 R
See application file for complete search history.

(56) References Cited

U.S. PATENT DOCUMENTS

| | | | | |
|---|---|---|---|---|
| 5,006,084 | A * | 4/1991 | Handa | 440/75 |
| 5,509,323 | A | 4/1996 | Hallenstvedt et al. | |
| 5,520,559 | A * | 5/1996 | Nakayasu et al. | 440/75 |
| 5,556,312 | A | 9/1996 | Ogino | |
| 5,601,464 | A | 2/1997 | Ogino et al. | |
| 5,788,546 | A * | 8/1998 | Ogino | 440/75 |
| 6,123,591 | A * | 9/2000 | Onoue | 440/75 |
| 6,386,350 | B1 * | 5/2002 | Sato | 192/51 |
| 6,893,305 | B2 * | 5/2005 | Natsume et al. | 440/75 |
| 7,297,036 | B1 | 11/2007 | Weronke et al. | |
| 7,621,792 | B2 * | 11/2009 | Fukuoka et al. | 440/89 R |
| 8,087,958 | B2 * | 1/2012 | Yukishima et al. | 440/75 |
| 2010/0124858 | A1 | 5/2010 | Okabe et al. | |
| 2012/0231683 | A1 * | 9/2012 | Kawaguchi | 440/75 |

FOREIGN PATENT DOCUMENTS

| | | | |
|---|---|---|---|
| JP | 63-258295 | A | 10/1988 |
| JP | 06-330990 | A | 11/1994 |
| JP | 11-263294 | A | 9/1999 |
| JP | 2000-016391 | A | 1/2000 |
| JP | 2001-106189 | A | 4/2001 |
| JP | 2002-308185 | A | 10/2002 |

OTHER PUBLICATIONS

Official Communication issued in corresponding European Patent Application No. 12154720.2, mailed on Jun. 29, 2012.

* cited by examiner

*Primary Examiner* — Lars A Olson
*Assistant Examiner* — Jovon Hayes
(74) *Attorney, Agent, or Firm* — Keating & Bennett, LLP

(57) ABSTRACT

A vessel propulsion apparatus includes a second shaft that is inserted in a first driven gear and in a second driven gear, that is connected to a dog clutch, and that is arranged to undergo a thrust. The vessel propulsion apparatus includes a first bearing disposed between the first driven gear and the second shaft, a second bearing disposed between the second driven gear and the second shaft, and a case to which a thrust applied to the second shaft is transmitted via the first bearing and the first driven gear or via the second bearing and the second driven gear. The vessel propulsion apparatus includes an adjusting member disposed between the second shaft and at least one of the first driven gear and the second driven gear and arranged to apply a preload onto the first bearing and the second bearing.

12 Claims, 18 Drawing Sheets

FIG. 8 Normal rotation specifications · Forward traveling

FIG. 9 Normal rotation specifications · Backward traveling

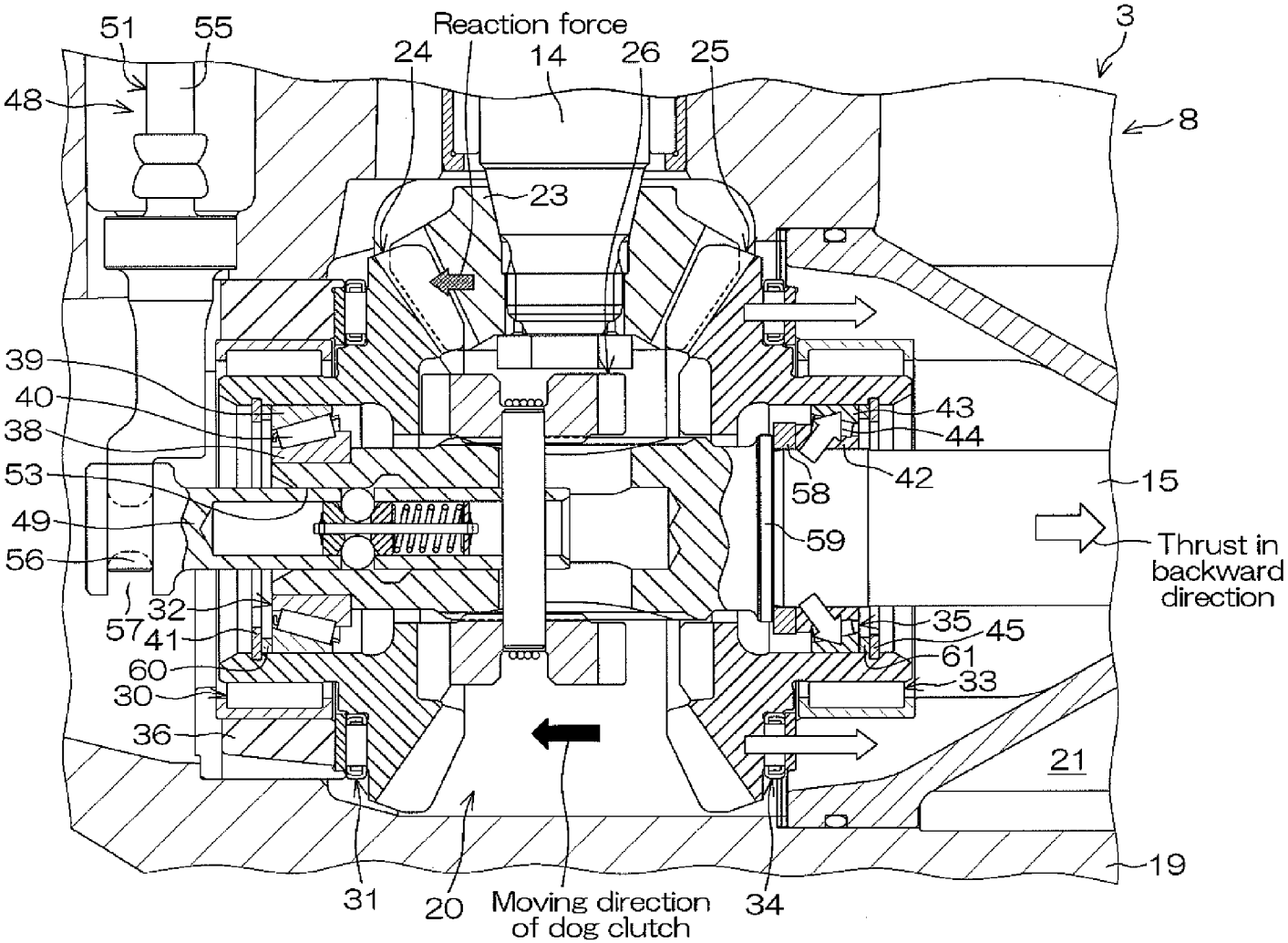
FIG. 11 Reverse rotation specifications · Backward traveling

Prior Art
FIG. 12 Ordinary use (Normal rotation specifications · Forward traveling)
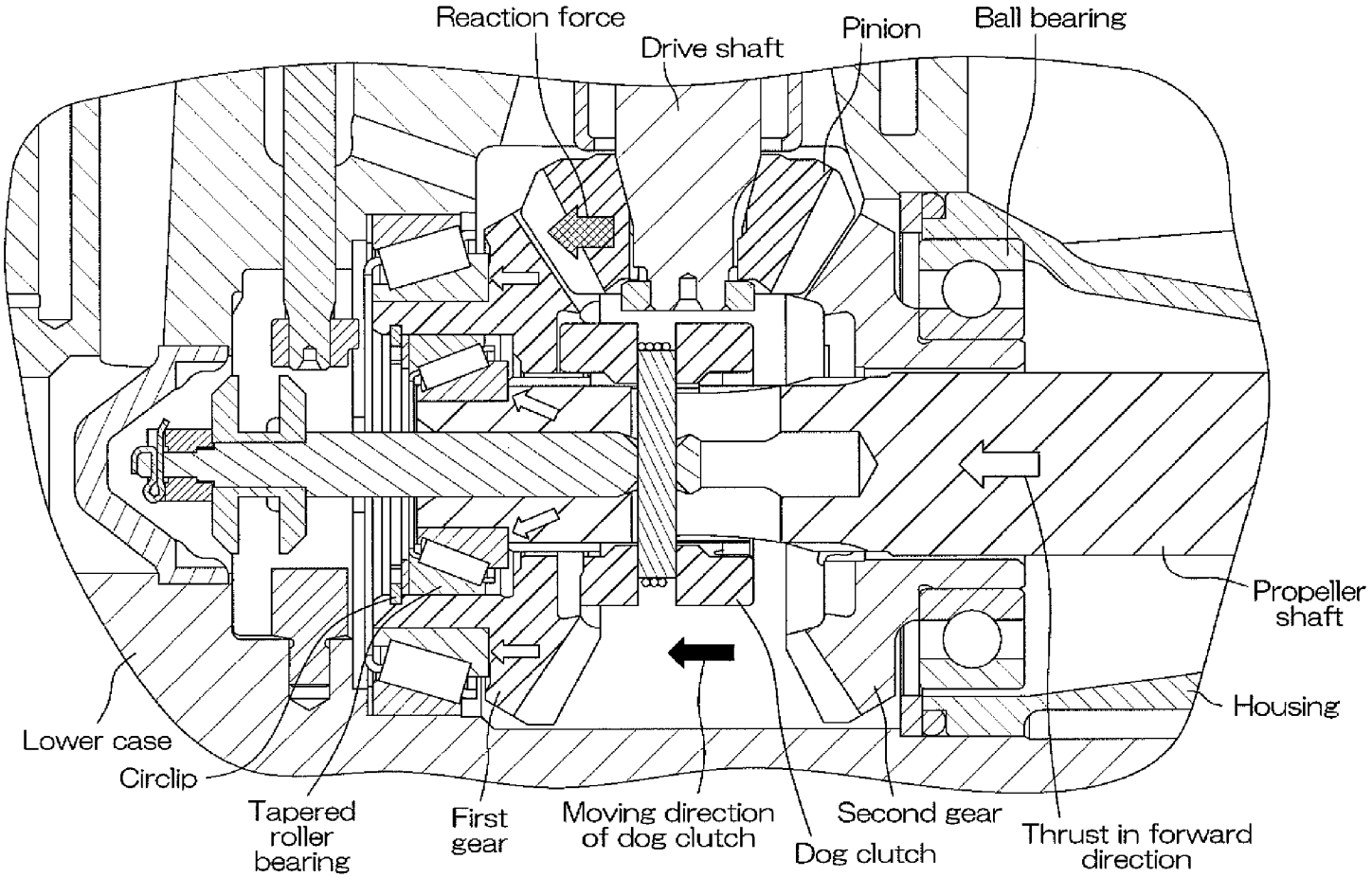

Prior Art
FIG. 13 Ordinary use (Normal rotation specifications · Backward traveling)
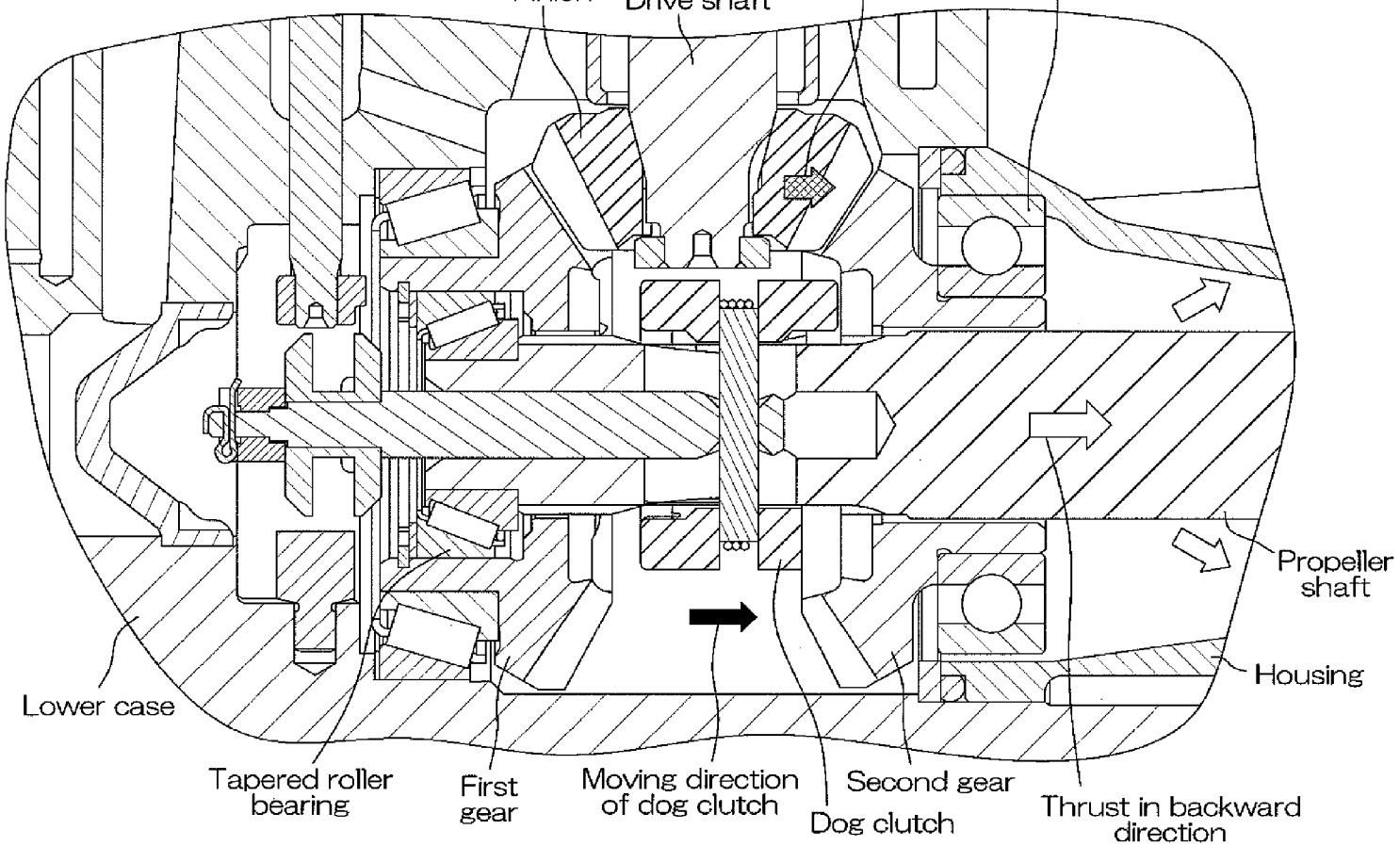

Prior Art
FIG. 14 Non-ordinary use (Reverse rotation specifications · Forward traveling)
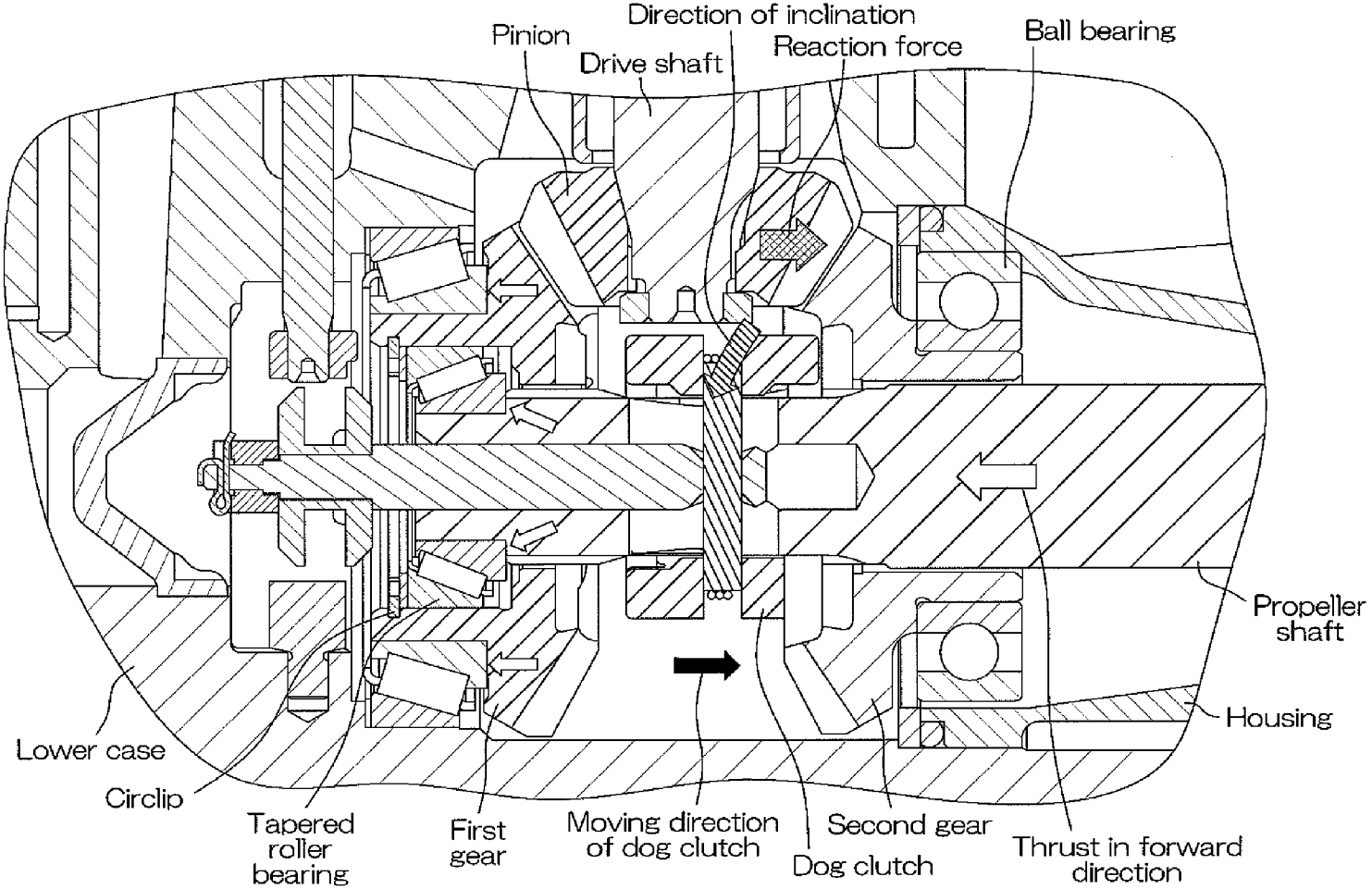

Prior Art
FIG. 15 Non-ordinary use (Reverse rotation specifications · Backward traveling)
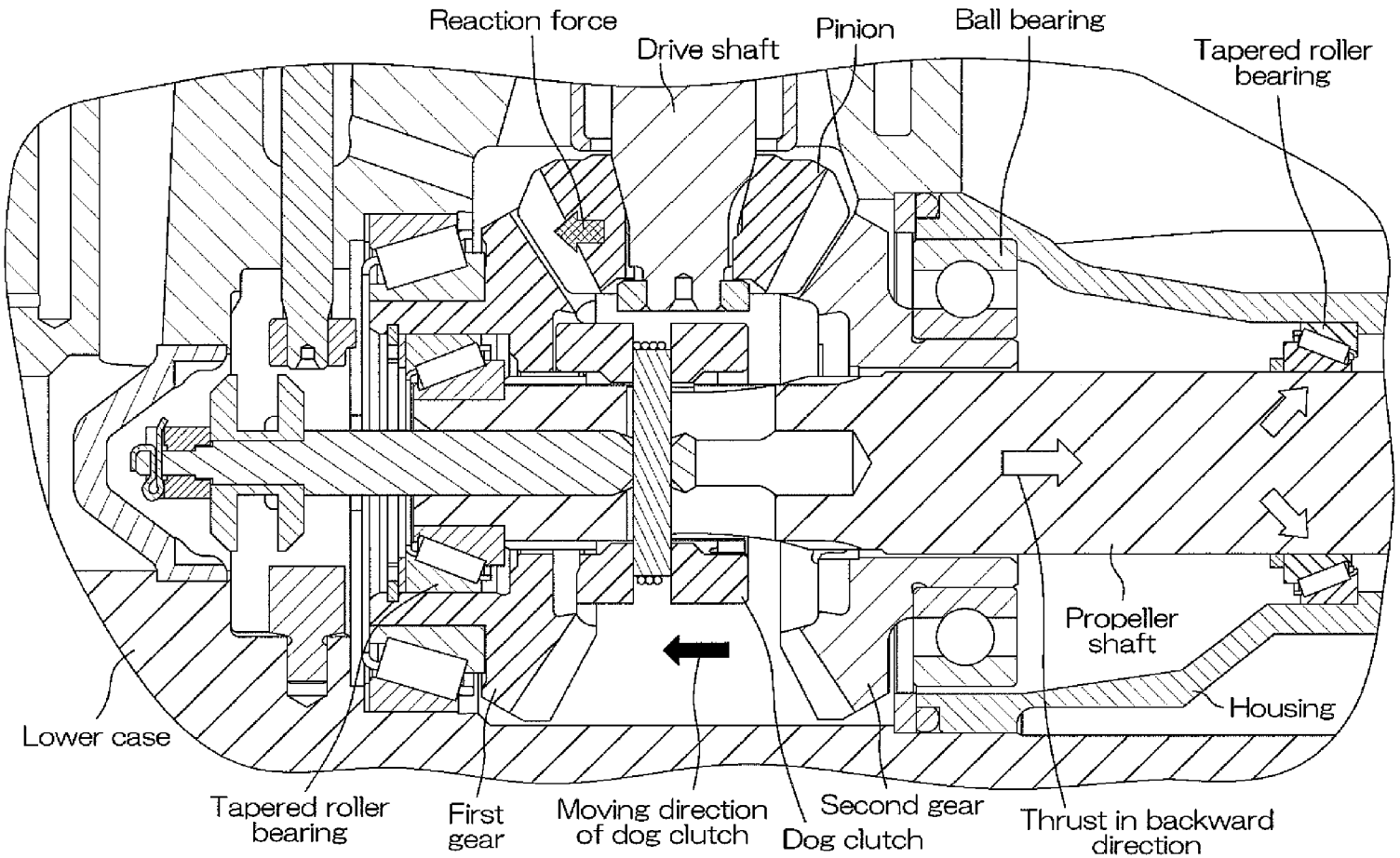

Prior Art
FIG. 16 Ordinary use (Reverse rotation specifications · Forward traveling)
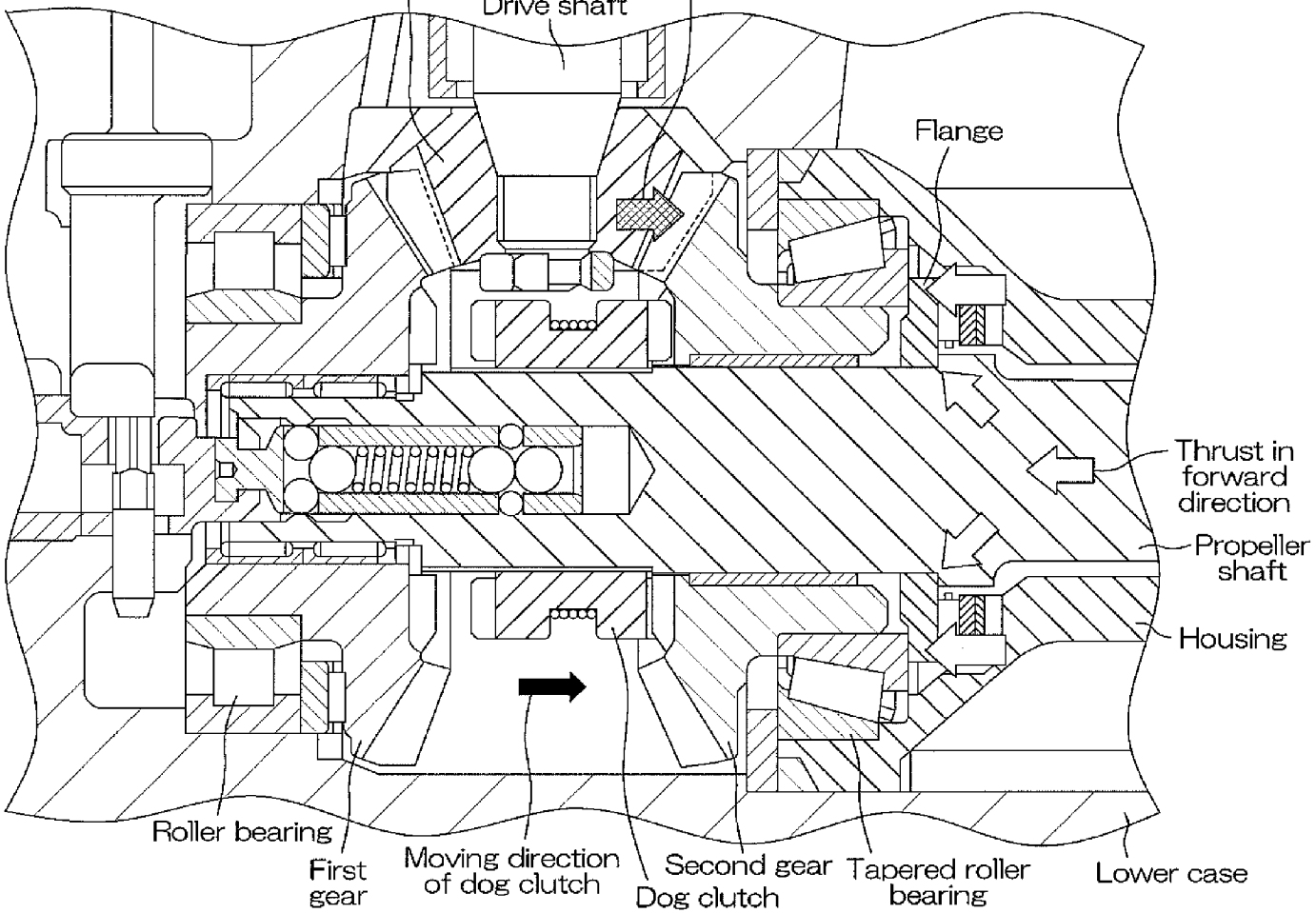

Prior Art
FIG. 17 Ordinary use (Reverse rotation specifications · Backward traveling)
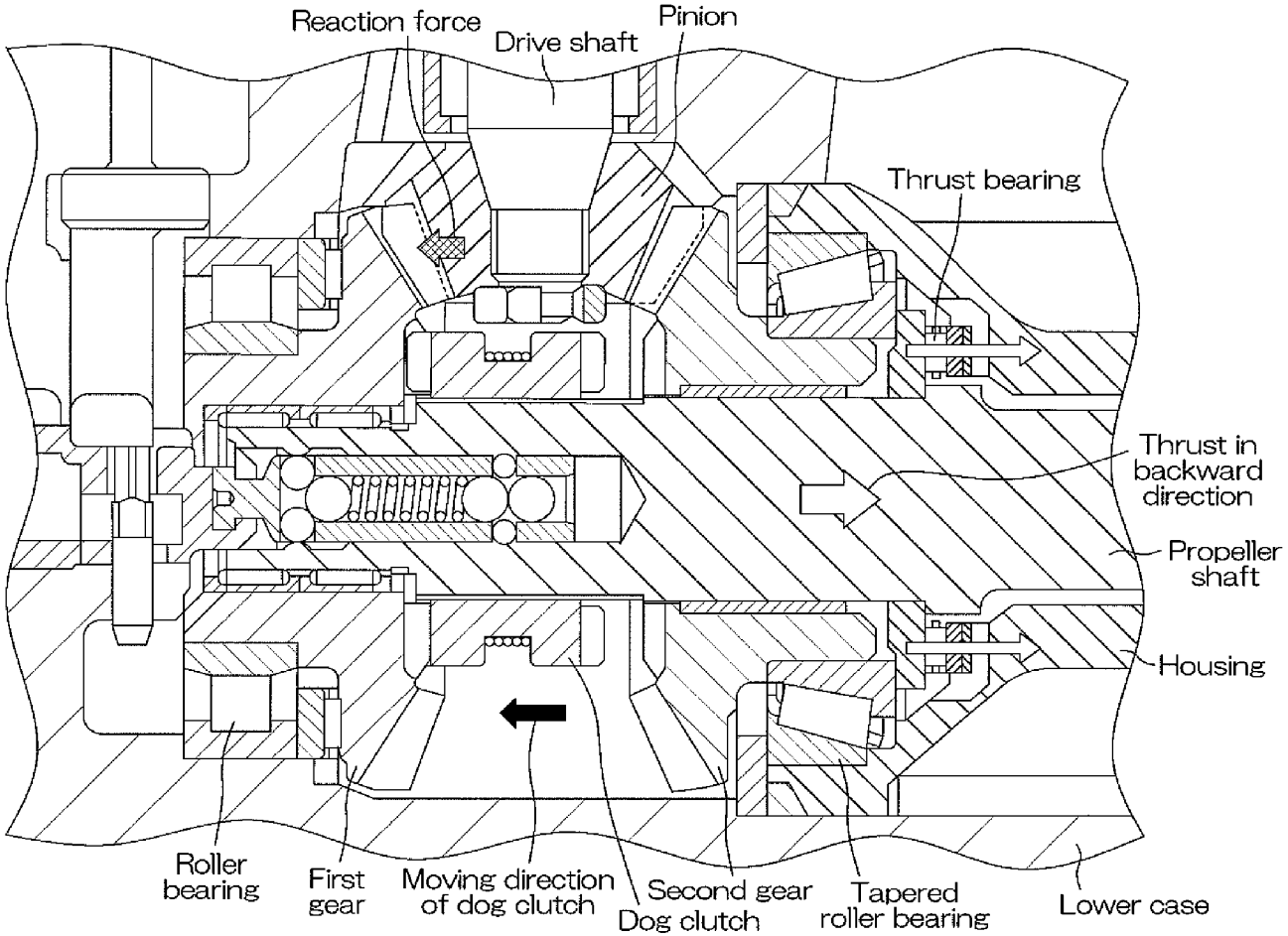

Prior Art
FIG. 18 Non-ordinary use (Normal rotation specifications · Forward traveling)
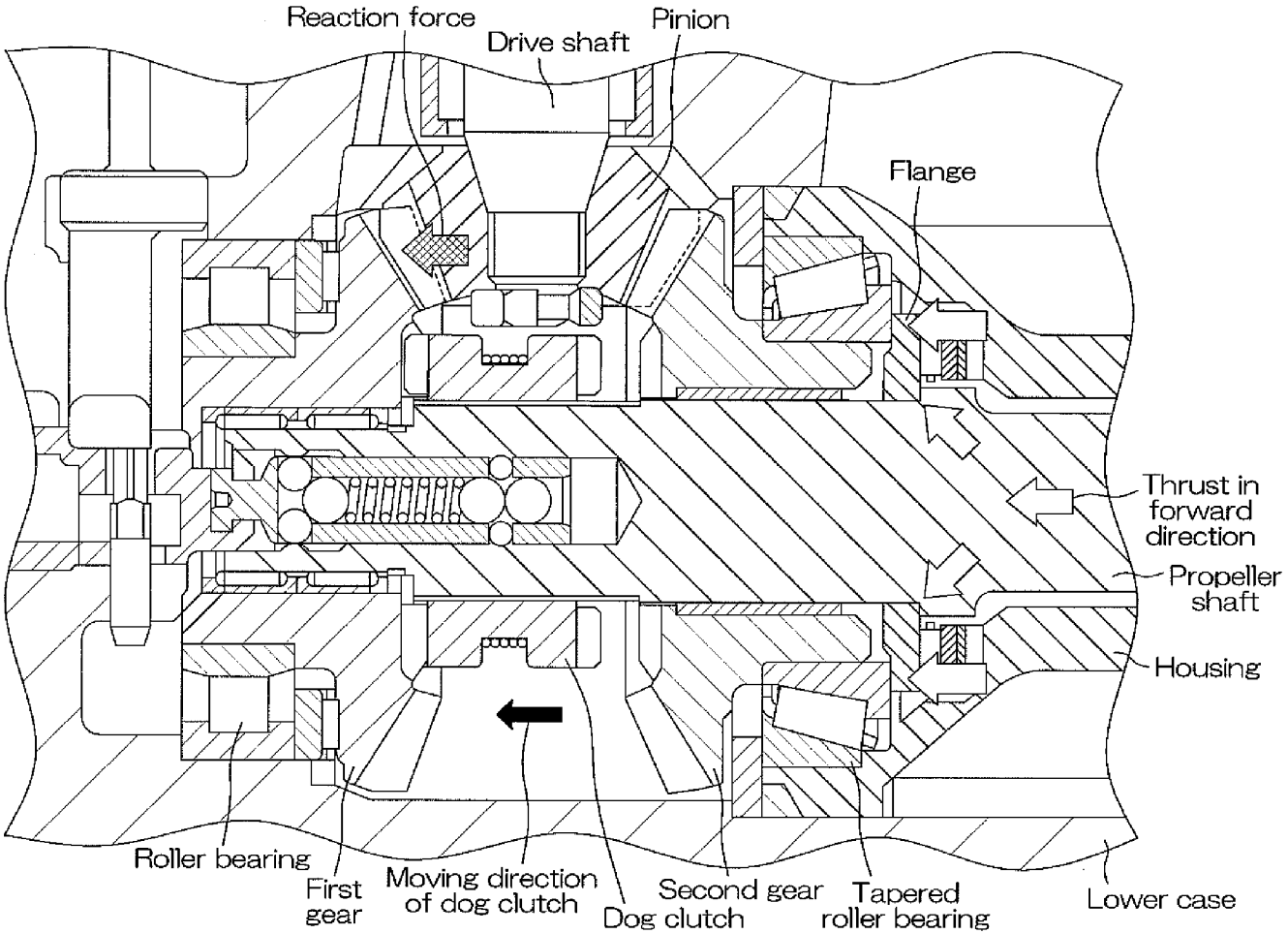

Prior Art
FIG. 19 Non-ordinary use (Normal rotation specifications · Backward traveling)
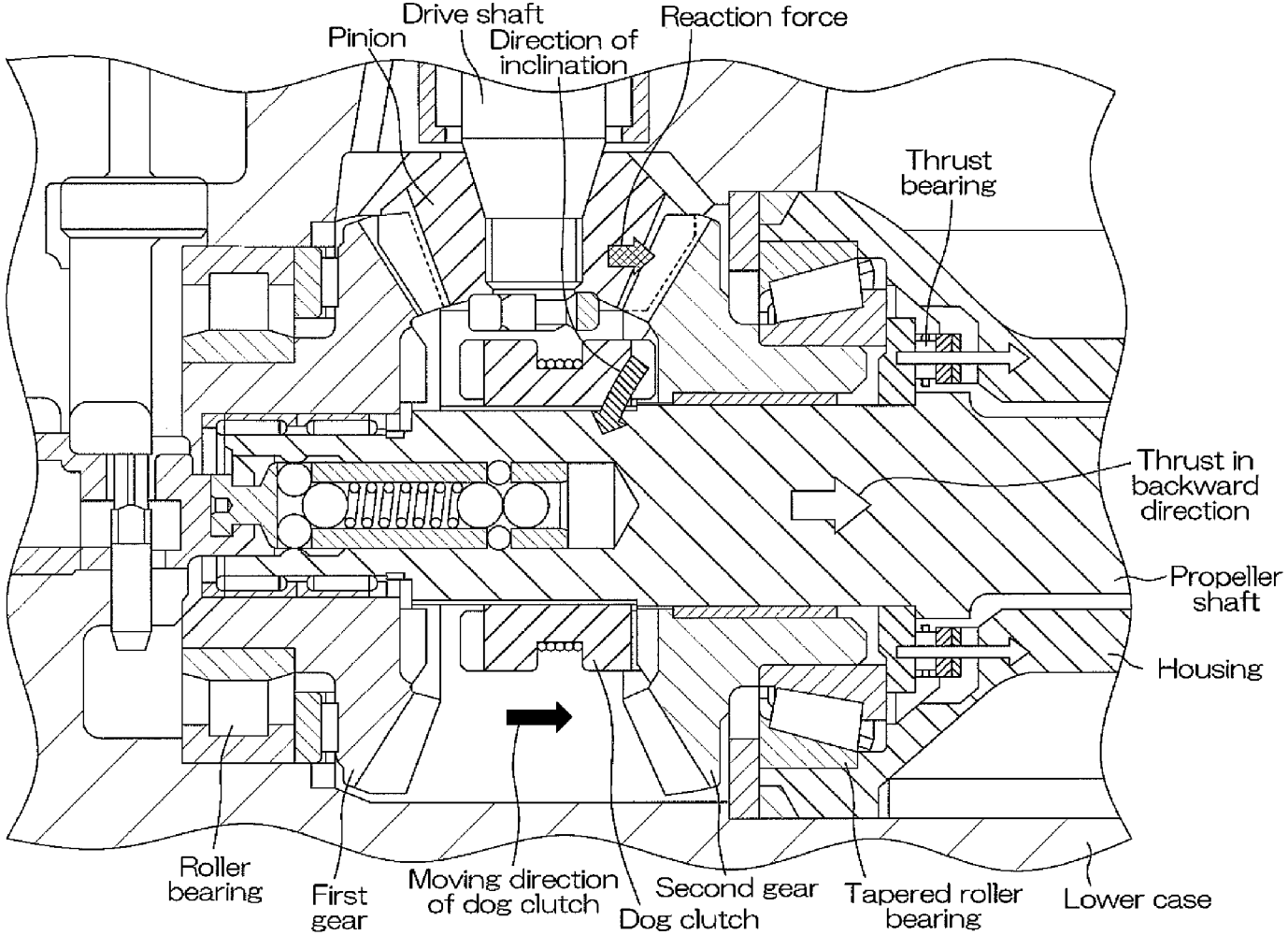

VESSEL PROPULSION APPARATUS

BACKGROUND OF THE INVENTION

1. Field of the Invention

The present invention relates to a vessel propulsion apparatus.

2. Description of the Related Art

A vessel propulsion apparatus having normal rotation specifications and a vessel propulsion apparatus having reverse rotation specifications are known. A propeller having normal rotation specifications that generates a thrust in a forward direction by rotating in a normal rotation direction is attached to the vessel propulsion apparatus having normal rotation specifications. On the other hand, a propeller having reverse rotation specifications that generates a thrust in the forward direction by rotating in a reverse rotation direction opposite to the normal rotation direction is attached to the vessel propulsion apparatus having reverse rotation specifications.

A conventional vessel propulsion apparatus disclosed in U.S. Pat. No. 7,297,036 is a vessel propulsion apparatus having normal rotation specifications (which is hereinafter referred to simply as a "normal-rotation vessel propulsion apparatus"), whereas a conventional vessel propulsion apparatus disclosed in Japanese Published Unexamined Patent Application No. H11-263294 is a vessel propulsion apparatus having reverse rotation specifications (which is hereinafter referred to simply as a "reverse-rotation vessel propulsion apparatus"). Additionally, a conventional vessel propulsion apparatus disclosed in Japanese Published Unexamined Patent Application No. S63-258295 is a vessel propulsion apparatus having normal/reverse rotation specifications (which is hereinafter referred to simply as a "normal/reverse-rotation vessel propulsion apparatus") that is capable of being used both according to normal rotation specifications and according to reverse rotation specifications.

The normal-rotation vessel propulsion apparatus of U.S. Pat. No. 7,297,036 includes a pinion (drive gear) that rotates together with a drive shaft, a first gear and a second gear that engage with the pinion, a dog clutch that is selectively connected to one of the first and second gears, and a propeller shaft that rotates together with the dog clutch. A propeller having normal rotation specifications (which is hereinafter referred to simply as a "normal-rotation propeller") is attached to the propeller shaft. When the dog clutch is connected to the first gear serving as a forward gear, the propeller shaft and the propeller rotate in a normal rotation direction. On the other hand, when the dog clutch is connected to the second gear serving as a reverse gear, the propeller shaft and the propeller rotate in a reverse rotation direction. Therefore, the rotation direction of the propeller is switched by the dog clutch. The first gear holds the propeller shaft via a tapered roller bearing disposed between the first gear and the propeller shaft, whereas the second gear is held by a housing via a ball bearing (e.g., see FIG. 12).

The reverse-rotation vessel propulsion apparatus of Japanese Published Unexamined Patent Application No. H11-263294 includes a pinion that rotates together with a drive shaft, a first gear (reverse gear) and a second gear (forward gear) that engage the pinion, a dog clutch that is selectively connected to one of the first and second gears, and a propeller shaft that rotates together with the dog clutch. A propeller having reverse rotation specifications (which is hereinafter referred to simply as a "reverse-rotation propeller") is attached to the propeller shaft. When the dog clutch is connected to the second gear serving as a forward gear, the propeller shaft and the propeller rotate in a reverse rotation direction. On the other hand, when the dog clutch is connected to the first gear serving as a reverse gear, the propeller shaft and the propeller rotate in a normal rotation direction. Therefore, the rotation direction of the propeller is switched by the dog clutch. The first gear is supported by a lower case via a roller bearing, whereas the second gear is supported by a housing via a tapered roller bearing (e.g., see FIG. 16).

The normal/reverse-rotation vessel propulsion apparatus of Japanese Published Unexamined Patent Application No. S63-258295 includes a pinion (gear) that rotates together with a drive shaft, a first gear (reverse gear) and a second gear (forward gear) that engage the pinion, a dog clutch that is selectively connected to one of the first and second gears, and a propeller shaft that rotates together with the dog clutch. A normal-rotation or reverse-rotation propeller is attached to the propeller shaft. When the dog clutch is connected to the first gear, the propeller shaft and the propeller rotate in a normal rotation direction. On the other hand, when the dog clutch is connected to the second gear, the propeller shaft and the propeller rotate in a reverse rotation direction. Therefore, the rotation direction of the propeller is switched by the dog clutch. Each of the first and second gears surrounds the propeller shaft, and is in a non-contact state with respect to the propeller shaft.

SUMMARY OF THE INVENTION

The inventor of preferred embodiments of the present invention described and claimed in the present application conducted an extensive study and research regarding a vessel propulsion apparatus, such as the one described above, and in doing so, discovered and first recognized new unique challenges and previously unrecognized possibilities for improvements as described in greater detail below.

In detail, the normal-rotation vessel propulsion apparatus and the reverse-rotation vessel propulsion apparatus include lower units, respectively, that differ from each other in structure. Therefore, components for use in the lower unit having normal rotation specifications differ from components for use in the lower unit having reverse rotation specifications, thus making it impossible to achieve a reduction in cost by making these components as dual-use components. Additionally, a retail outlet for such vessel propulsion apparatuses is required to stock components for use in the lower unit having normal rotation specifications and components for use in the lower unit having reverse rotation specifications as spare components used for repairs, and therefore the stock will be increased.

As described above, the normal-rotation or reverse-rotation vessel propulsion apparatus can rotate the propeller both in the normal rotation direction and in the reverse rotation direction by switching the dog clutch. Therefore, in principle, the normal-rotation vessel propulsion apparatus can be used according to reverse rotation specifications by attaching a reverse-rotation propeller to the normal-rotation vessel propulsion apparatus. Likewise, in principle, the reverse-rotation vessel propulsion apparatus can be used according to normal rotation specifications by attaching a normal-rotation propeller to the reverse-rotation vessel propulsion apparatus. However, as described below with regard to the durability of gears, there is a possibility that the durability of gears (pinion, first gear, and second gear) will be decreased if the vessel propulsion apparatus including one of the two different kinds of specifications is used according to the other of the two different kinds of specifications.

In the normal-rotation or reverse-rotation vessel propulsion apparatus, the first gear and the second gear are disposed in front of and behind the pinion, respectively. The pinion always engages the first gear and the second gear, and, when the rotation of the pinion is transmitted to the first gear and to the second gear, the first and second gears rotate in mutually opposite directions. When the propeller is rotated, the dog clutch is connected to one of the first and second gears. Therefore, in the normal-rotation or reverse-rotation vessel propulsion apparatus, the first and second gears have the necessity of being capable of relatively rotating with respect to both the lower case and the propeller shaft. Therefore, it is difficult to fix the position of the first gear and that of the second gear. In other words, it is difficult to hold the first and second gears so as not to perform an operation other than rotation. Therefore, as described below, there is a possibility that the first and second gears are inclined or are moved in an axial direction of the propeller shaft, depending on how to use the vessel propulsion apparatus.

FIG. 12 shows a state of a lower unit when the vessel travels forwardly with the normal-rotation vessel propulsion apparatus. As shown in FIG. 12, when the normal-rotation vessel propulsion apparatus generates a thrust in the forward direction, a dog clutch is engaged with a first gear serving as a forward gear (see the black arrow). As a result, the rotation of a drive shaft is transmitted to the dog clutch via a pinion and the first gear. A normal-rotation propeller rotates in a normal rotation direction together with the dog clutch and a propeller shaft. A thrust in the forward direction generated by the rotation of the propeller in the normal rotation direction is transmitted to the propeller shaft, a tapered roller bearing, a circlip, the first gear, an outer tapered roller bearing, and a lower case in this order (see the white arrow). On the other hand, a reaction force caused by the transmission of power from the pinion to the first gear is applied to the first gear at an engagement position of the pinion and the first gear (see the crosshatched arrow). As a result, a force by which the first gear is inclined is applied to the first gear. However, the position of the first gear is fixed by the transmission of a thrust in the forward direction to the first gear via the tapered roller bearing, and therefore the first gear will not be easily inclined even if a reaction force is applied to the first gear. Therefore, the engagement between the pinion and the first gear becomes stable, and a force greater than a designed, assumed value is prevented from being applied to the first gear.

FIG. 13 shows a state of the lower unit when the vessel travels backwardly with the normal-rotation vessel propulsion apparatus. As shown in FIG. 13, when the normal-rotation vessel propulsion apparatus generates a thrust in a backward direction, the dog clutch is engaged with the second gear serving as a reverse gear (see the black arrow). As a result, the rotation of the drive shaft is transmitted to the dog clutch via the pinion and the second gear. The normal-rotation propeller rotates in a reverse rotation direction together with the dog clutch and the propeller shaft. A thrust in the backward direction generated by the rotation of the propeller in the reverse rotation direction is transmitted to the propeller shaft and the housing in this order (see the white arrow). On the other hand, a reaction force caused by the transmission of power from the pinion to the second gear is applied to the second gear at an engagement position of the pinion and the second gear (see the crosshatched arrow). However, when the vessel travels backwardly, torque transmitted from the pinion to the second gear is smaller than when the vessel travels forwardly, and therefore a reaction force applied to the second gear is also smaller. Therefore, the amount of inclination of the second gear is smaller than when the vessel travels forwardly.

FIG. 14 shows a state of the lower unit when the vessel travels forwardly in a case in which the normal-rotation vessel propulsion apparatus is used as a reverse-rotation vessel propulsion apparatus being in a non-ordinary use state. As shown in FIG. 14, when the normal-rotation vessel propulsion apparatus used according to reverse rotation specifications generates a thrust in the forward direction, the dog clutch is engaged with the second gear serving as a forward gear (see the black arrow). As a result, the rotation of the drive shaft is transmitted to the dog clutch via the pinion and the second gear, and the reverse-rotation propeller rotates in the reverse rotation direction together with the dog clutch and the propeller shaft. A thrust in the forward direction generated by the rotation of the propeller in the reverse rotation direction is transmitted to the propeller shaft, the tapered roller bearing, the circlip, the first gear, the outer tapered roller bearing, and the lower case in this order (see the white arrow). On the other hand, a reaction force caused by the transmission of power from the pinion to the second gear is applied to the second gear (see the crosshatched arrow). This reaction force is applied to a ball bearing, and, as a result, the second gear is greatly inclined by the inclination of the ball bearing (see the hatched arrow). Therefore, there is a possibility that the engagement between the pinion and the second gear will become unstable, and a force greater than a designed, assumed value will be applied to the engagement position of the pinion and the second gear.

FIG. 15 shows a state of the lower unit when the vessel travels backwardly in a case in which the normal-rotation vessel propulsion apparatus is used as a reverse-rotation vessel propulsion apparatus being in a non-ordinary use state. As shown in FIG. 15, when the normal-rotation vessel propulsion apparatus used according to reverse rotation specifications generates a thrust in the backward direction, the dog clutch is engaged with the first gear serving as a reverse gear (see the black arrow). As a result, the rotation of the drive shaft is transmitted to the dog clutch via the pinion and the first gear, and the reverse-rotation propeller rotates in the normal rotation direction together with the dog clutch and the propeller shaft. A thrust in the backward direction generated by the rotation of the propeller in the normal rotation direction is transmitted to the propeller shaft, the tapered roller bearing, and the housing in this order (see the white arrow). On the other hand, a reaction force caused by the transmission of the rotation from the pinion to the first gear is applied to the first gear at an engagement position of the pinion and the first gear (see the crosshatched arrow). However, when the vessel travels backwardly, the reaction force applied to the first gear is small, and therefore the amount of inclination of the first gear is small.

FIG. 16 shows a state of the lower unit when the vessel travels forwardly with the reverse-rotation vessel propulsion apparatus. As shown in FIG. 16, when the reverse-rotation vessel propulsion apparatus generates a thrust in the forward direction, the second gear serving as a forward gear is engaged with the dog clutch (see the black arrow). As a result, the rotation of the drive shaft is transmitted to the dog clutch via the pinion and the second gear, and the reverse-rotation propeller rotates in the reverse rotation direction together with the dog clutch and the propeller shaft. In the reverse-rotation vessel propulsion apparatus, a thrust generated by the rotation of the propeller is transmitted via a flange attached to the propeller shaft. A thrust in the forward direction generated by the rotation of the propeller in the reverse rotation direction is transmitted to the propeller shaft, the tapered roller bearing, and the housing in this order (see the white arrow). On the other hand, a reaction force caused by the transmission of power from the pinion to the second gear is applied to the second gear at an engagement position of the pinion and the second gear (see the crosshatched arrow). The direction of the thrust applied to the tapered roller bearing via the propeller shaft is opposite to the direction of the reaction force applied to the tapered roller bearing via the second gear. However, the reaction force applied to the second gear is sufficiently smaller than the magnitude of the thrust applied in the forward direction, and therefore the axial center of the tapered roller bearing becomes stable, and the position of the second gear is fixed. Therefore, the second gear is restrained from being inclined or being moved in the axial direction.

FIG. 17 shows a state of the lower unit when the vessel travels backwardly with the reverse-rotation vessel propulsion apparatus. As shown in FIG. 17, when the reverse-rotation vessel propulsion apparatus generates a thrust in the backward direction, the dog clutch is engaged with the first gear serving as a reverse gear (see the black arrow). As a result, the rotation of the drive shaft is transmitted to the dog clutch via the pinion and the first gear, and the reverse-rotation propeller rotates in the normal rotation direction together with the dog clutch and the propeller shaft. A thrust in the backward direction generated by the rotation of the propeller in the normal rotation direction is transmitted to the propeller shaft, a thrust bearing, and the housing in this order (see the white arrow). On the other hand, a reaction force caused by the transmission of power from the pinion to the first gear is applied to the first gear at an engagement position of the pinion and the first gear (see the crosshatched arrow). However, the reaction force applied to the first gear is small when the vessel travels backwardly, and therefore the amount of inclination of the first gear is small.

FIG. 18 shows a state of the lower unit when the vessel travels forwardly in a case in which the reverse-rotation vessel propulsion apparatus is used as a normal-rotation vessel propulsion apparatus being in a non-ordinary use state. As shown in FIG. 18, when the reverse-rotation vessel propulsion apparatus used according to normal rotation specifications generates a thrust in the forward direction, the dog clutch is engaged with the first gear serving as a forward gear (see the black arrow). As a result, the rotation of the drive shaft is transmitted to the dog clutch via the pinion and the first gear, and the normal-rotation propeller rotates in the normal rotation direction together with the dog clutch and the propeller shaft. A thrust in the forward direction generated by the rotation of the propeller in the normal rotation direction is transmitted to the propeller shaft, the tapered roller bearing, and the housing in this order (see the white arrow). At that time, the rotation direction of the propeller shaft and the rotation direction of the tapered roller bearing that supports the second gear are inverted, and therefore the flange of the propeller shaft rotates against the tapered roller bearing. Therefore, wearing of the flange and the tapered roller bearing occurs.

FIG. 19 shows a state of the lower unit when the vessel travels backwardly in a case in which the reverse-rotation vessel propulsion apparatus is used as a normal-rotation vessel propulsion apparatus being in a non-ordinary use state. As shown in FIG. 19, when the reverse-rotation vessel propulsion apparatus used according to normal rotation specifications generates a thrust in the backward direction, the dog clutch is engaged with the second gear serving as a reverse gear (see the black arrow). As a result, the rotation of the drive shaft is transmitted to the dog clutch via the pinion and the second gear, and the normal-rotation propeller rotates in the reverse rotation direction together with the dog clutch and the propeller shaft. A thrust in the backward direction generated by the rotation of the propeller in the reverse rotation direction is transmitted to the propeller shaft, the thrust bearing, and the housing in this order (see the white arrow). At this time, unlike a case in which the vessel travels forwardly in the ordinary use, only the reaction force caused by the transmission of the rotation from the pinion to the second gear is applied to the second gear (see the crosshatched arrow), and therefore the axial center of the tapered roller bearing is not stabilized, and the second gear becomes unstable, and, as a result, the amount of inclination thereof is increased (see the hatched arrow).

As described above, there is a possibility that the displacement of gears, i.e., the inclination or movement in the axial direction of gears will occur, and the durability of these gears will be decreased if the vessel propulsion apparatus having one of the two different kinds of specifications is used according to the other of the two different kinds of specifications. For example, it is conceivable that a decrease in durability of gears can be prevented if the gears are enlarged. However, if the gears are enlarged, the lower unit of the vessel propulsion apparatus is enlarged, and, as a result, the resistance of water is increased. Therefore, it is preferable to decrease the amount of displacement of each gear as much as possible without enlarging the lower unit of the vessel propulsion apparatus.

It is conceivable that the gear displacement will be prevented by fixing the position of the first gear and that of the second gear. In other words, the inclination or the like of the first and second gears will not occur if the position of the first gear and that of the second gear are fixed, i.e., if the first and second gears are held so as not to perform an operation other than the rotation thereof. However, as described above, the first and second gears must be capable of relatively rotating with respect to both the propeller shaft and the lower case. Therefore, in the conventional vessel propulsion apparatuses, the position of the first gear and that of the second gear are not fixed.

For example, in the normal-rotation vessel propulsion apparatus of U.S. Pat. No. 7,297,036, a thrust in the forward direction is transmitted to the propeller shaft, the tapered roller bearing, and the first gear in this order when the vessel travels forwardly in the ordinary use, and therefore the position of the first gear is fixed when the vessel travels forwardly. However, the position of the first gear is not fixed when a thrust in the forward direction is generated by using this normal-rotation vessel propulsion apparatus according to reverse rotation specifications. In other words, the vessel propulsion apparatus is required to have an intrinsic function to relatively rotate the first and second gears with respect to, for example, the propeller shaft and a function that conflicts with this intrinsic function, i.e., a function to fix the position of the first gear and that of the second gear. To realize these two functions, conventionally, a normal-rotation vessel propulsion apparatus and a reverse-rotation vessel propulsion apparatus have been provided, and these vessel propulsion apparatuses having the two different kinds of specifications have been used properly according to circumstances.

Thus, it is difficult in practice to use the vessel propulsion apparatus having one of the two different kinds of specifications according to the other one although it is possible in principle. Although Japanese Published Unexamined Patent Application No. S63-258295 discloses the normal/reverse-rotation vessel propulsion apparatus, there is a possibility that the first and second gears will be inclined or moved in the axial direction in the same way as above. Therefore, there is a possibility that the durability of the gears will be decreased.

In order to overcome the previously unrecognized and unsolved challenges described above, one preferred embodiment of the present invention provides a vessel propulsion apparatus that includes a first shaft, a drive gear, a first driven gear, a second driven gear, a dog clutch, a second shaft, a first bearing, a second bearing, a case, and an adjusting member. The first shaft is a rotationally driven shaft. The drive gear is connected to the first shaft. The first driven gear and the second driven gear are tubular gears that engage the drive gear. The dog clutch is switched by a shift operation between a connected state in which the dog clutch is connected to one of the first driven gear and the second driven gear and a non-connected state in which the dog clutch is not connected to both the first driven gear and the second driven gear. The second shaft is inserted in the first driven gear and in the second driven gear, is connected to the dog clutch, and is arranged to undergo a thrust. The first bearing is disposed between the first driven gear and the second shaft. The second bearing is disposed between the second driven gear and the second shaft. The case contains the drive gear, the first driven gear, the second driven gear, the dog clutch, the first bearing, and the second bearing. A thrust applied to the second shaft is transmitted to the case via the first bearing and the first driven gear or via the second bearing and the second driven gear. The adjusting member is disposed between the second shaft and at least one of the first driven gear and the second driven gear, and is arranged to apply a preload onto the first bearing and the second bearing.

With this arrangement of the present preferred embodiment of the present invention, the first shaft is rotationally driven, and hence the first driven gear and the second driven gear are rotationally driven by the drive gear. Additionally, the dog clutch is connected to one of the first driven gear and the second driven gear, and hence the rotation of one of the driven gears is transmitted to the second shaft via the dog clutch. Therefore, the rotation of the first shaft is transmitted to the second shaft via the drive gear and so forth. The second shaft is inserted in the first driven gear and in the second driven gear. The first bearing is disposed between the first driven gear and the second shaft, whereas the second bearing is disposed between the second driven gear and the second shaft. A preload is applied onto the first bearing and onto the second bearing by the adjusting member disposed between the second shaft and at least one of the first driven gear and the second driven gear.

As described above, a preload is applied onto the first bearing that rotatably supports the first driven gear and onto the second bearing that rotatably supports the second driven gear, and therefore an internal gap of the first bearing and that of the second bearing can be removed, and the position of the first driven gear and that of the second driven gear can be fixed. In other words, the first driven gear and the second driven gear can be held so as not to perform an operation other than rotation. Therefore, the engagement between the drive gear and each gear (i.e., each of the first and second driven gears) can be prevented from becoming unstable even when the vessel propulsion apparatus is used according to either normal or reverse rotation specifications. This makes it possible to prevent the durability of the gears from being decreased. Therefore, the vessel propulsion apparatus can be used according to either normal or reverse rotation specifications.

The position of each of the first and second gears can be fixed, and the vessel propulsion apparatus can be used according to either normal or reverse rotation specifications as described above, and therefore there is no need to provide special or unique components exclusively for use in each of the two different kinds of specifications. Therefore, it is possible to reduce the production costs and the number of development man-hours of the vessel propulsion apparatus. Additionally, the retail outlet of the vessel propulsion apparatus has no need to stock special or unique components as spare components used for repairs for each of the specifications. Moreover, the first and second bearings and the first and second driven gears can remove their backlashes by applying a preload onto the first and second bearings, and therefore it is possible to prevent the occurrence of an abnormal noise caused by these backlashes.

The first bearing may include a first inner race connected to the second shaft and a first outer race connected to the first driven gear. The second bearing may include a second inner race connected to the second shaft and a second outer race connected to the second driven gear.

The adjusting member may be disposed between the first bearing and the second bearing.

The second shaft may include a flange disposed between the first bearing and the second bearing, and the adjusting member may be disposed between the flange and one of the first bearing and the second bearing.

The case may define an internal space in which the first driven gear and the second driven gear are contained and an opening connected to the internal space, and the second driven gear may be disposed between the opening and the first driven gear. In this case, the adjusting member may be disposed between the second driven gear and the second shaft.

The first driven gear and the second driven gear may be the same in shape. That is, the first driven gear and the second driven gear may be the same type of gear.

Each of the drive gear, the first driven gear, and the second driven gear may include a bevel gear.

Each of the first bearing and the second bearing may include a tapered roller bearing.

The first shaft may include a drive shaft that extends in a vertical direction, and the second shaft may include a propeller shaft that extends in a horizontal direction.

The vessel propulsion apparatus may further include a third bearing disposed between the first driven gear and the case and a fourth bearing disposed between the second driven gear and the case.

Another preferred embodiment of the present invention provides a vessel propulsion apparatus that includes a first shaft, a drive gear, a first driven gear, a second driven gear, a dog clutch, a second shaft, a first bearing, a second bearing, and a case. The first shaft is a rotationally driven shaft. The drive gear is connected to the first shaft. The first driven gear has a tubular shape, and engages the drive gear, and is pressed forwardly. The second driven gear has a tubular shape, and engages the drive gear, and is pressed backwardly. The dog clutch is switched by a shift operation between a connected state in which the dog clutch is connected to one of the first driven gear and the second driven gear and a non-connected state in which the dog clutch is not connected to both the first driven gear and the second driven gear. The second shaft is inserted in the first driven gear and in the second driven gear, and is connected to the dog clutch, and is arranged to undergo a thrust. The first bearing is disposed between the first driven gear and the second shaft. The second bearing is disposed between the second driven gear and the second shaft. The case contains the drive gear, the first driven gear, the second driven gear, the dog clutch, the first bearing, and the second bearing. A thrust applied to the second shaft is transmitted to the case via the first bearing and the first driven gear or via the second bearing and the second driven gear. The vessel propulsion apparatus may further include an adjusting member arranged to press the first driven gear forwardly and to press the second driven gear press backwardly. The adjusting member may be disposed between the second shaft and at least one of the first driven gear and the second driven gear. The adjusting member may be arranged to apply a preload onto the first bearing and the second bearing.

Still another preferred embodiment of the present invention provides a vessel propulsion apparatus that includes a first shaft, a drive gear, a first driven gear, a second driven gear, a dog clutch, a second shaft, a first bearing, a second bearing, a case, and an adjusting member. The first shaft is a rotationally driven shaft. The drive gear is connected to the first shaft. The first driven gear and the second driven gear are tubular, and engage the drive gear. The dog clutch is switched by a shift operation between a connected state in which the dog clutch is connected to one of the first driven gear and the second driven gear and a non-connected state in which the dog clutch is not connected to both the first driven gear and the second driven gear. The second shaft is inserted in the first driven gear and in the second driven gear, and is connected to the dog clutch, and is arranged to undergo a thrust. The first bearing is disposed between the first driven gear and the second shaft. The second bearing is disposed between the second driven gear and the second shaft. The case contains the drive gear, the first driven gear, the second driven gear, the dog clutch, the first bearing, and the second bearing. A thrust applied to the second shaft is transmitted to the case via the first bearing and the first driven gear or via the second bearing and the second driven gear. The adjusting member is disposed between the second driven gear and the second shaft, and is arranged to apply a preload onto the first bearing and the second bearing. The second shaft includes a flange disposed between the dog clutch and the second bearing. The adjusting member is disposed between the flange and the second bearing.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 11 is a sectional view of the lower unit of the outboard motor according to the first preferred embodiment of the present invention.

FIG. 12 is a sectional view for describing a force transmission path when a conventional normal-rotation vessel propulsion apparatus generates a thrust in a forward direction.

FIG. 13 is a sectional view for describing a force transmission path when a conventional normal-rotation vessel propulsion apparatus generates a thrust in a backward direction.

FIG. 14 is a sectional view for describing a force transmission path when the conventional normal-rotation vessel propulsion apparatus is used according to reverse rotation specifications and generates a thrust in the forward direction.

FIG. 15 is a sectional view for describing a force transmission path when the conventional normal-rotation vessel propulsion apparatus is used according to reverse rotation specifications and generates a thrust in the backward direction.

FIG. 16 is a sectional view for describing a force transmission path when a conventional reverse-rotation vessel propulsion apparatus generates a thrust in a forward direction.

FIG. 17 is a sectional view for describing a force transmission path when a conventional reverse-rotation vessel propulsion apparatus generates a thrust in a backward direction.

FIG. 18 is a sectional view for describing a force transmission path when the conventional reverse-rotation vessel propulsion apparatus is used according to normal rotation specifications and generates a thrust in the forward direction.

FIG. 19 is a sectional view for describing a force transmission path when the conventional reverse-rotation vessel propulsion apparatus is used according to normal rotation specifications and generates a thrust in the backward direction.

DETAILED DESCRIPTION OF THE PREFERRED EMBODIMENTS

First Preferred Embodiment

Figure 1:
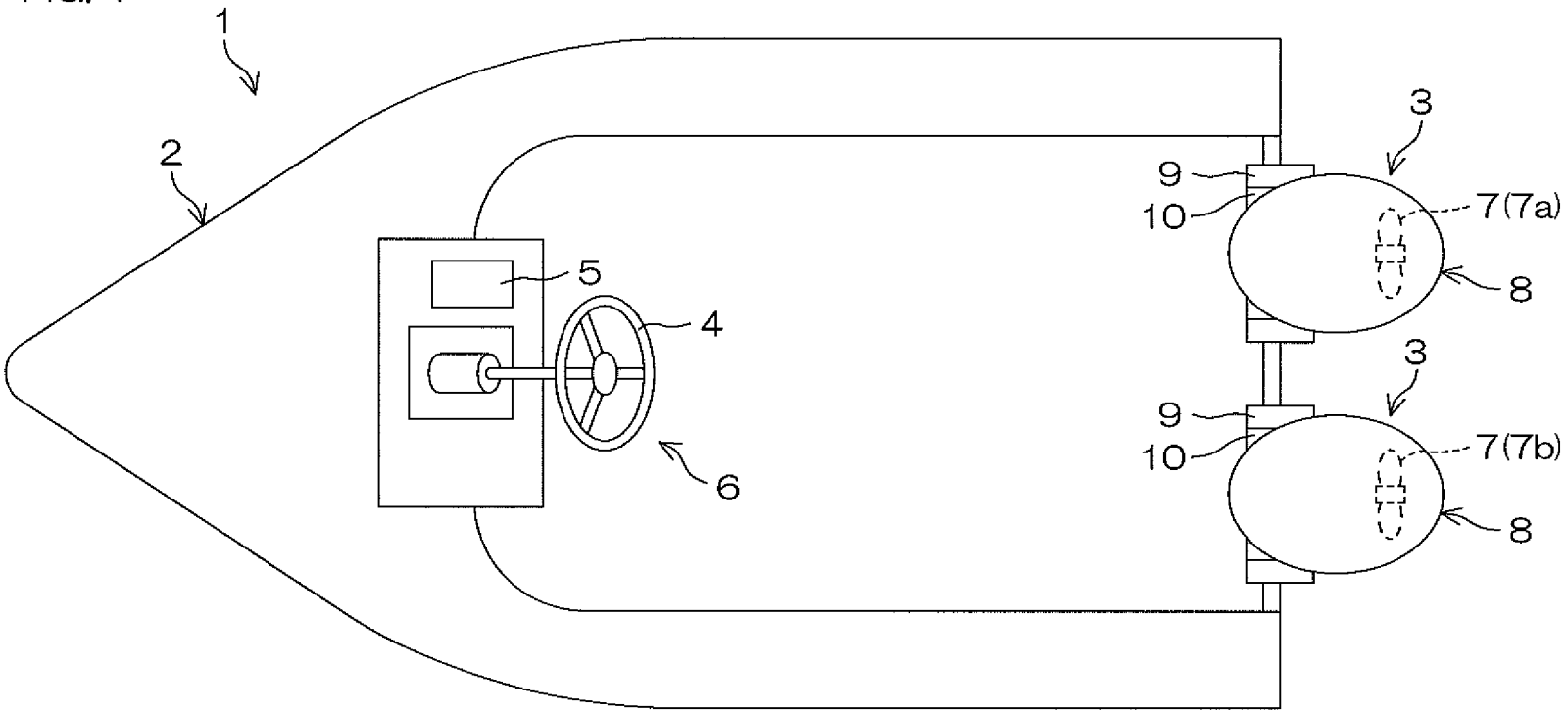
FIG. 1 is a plan view of a vessel according to a first preferred embodiment of the present invention.

FIG. 1 is a plan view of a vessel 1 according to a first preferred embodiment of the present invention.

The vessel 1 preferably includes a hull 2, two vessel propulsion apparatuses 3 that generate a thrust, a handle 4 operated by a vessel operator to steer the vessel 1, and a remote control 5 operated by the vessel operator to perform switching between forward traveling and backward traveling of the vessel 1 and to adjust vessel speed. The handle 4 and the remote control 5 are disposed at a vessel operating portion 6 provided in the hull 2. The two vessel propulsion apparatuses 3 are attached to the rear portion of the hull 2. Each vessel propulsion apparatus 3 is a normal/reverse-rotation vessel propulsion apparatus that can be used according to both normal rotation specifications and reverse rotation specifications. One of the vessel propulsion apparatuses 3 is used according to normal rotation specifications, and a normal-rotation propeller 7*a* that generates a thrust in a forward direction by rotating in a normal rotation direction (e.g., clockwise when viewed from behind) is attached to this vessel propulsion apparatus 3. The other vessel propulsion apparatus 3 is used according to reverse rotation specifications, and a reverse-rotation propeller 7*b* that generates a thrust in the forward direction by rotating in a reverse rotation direction opposite to the normal rotation direction is attached to this vessel propulsion apparatus 3. The rotation direction and the rotation speed of each propeller 7 are changed by the remote control 5 operated by the vessel operator.

Figure 2:
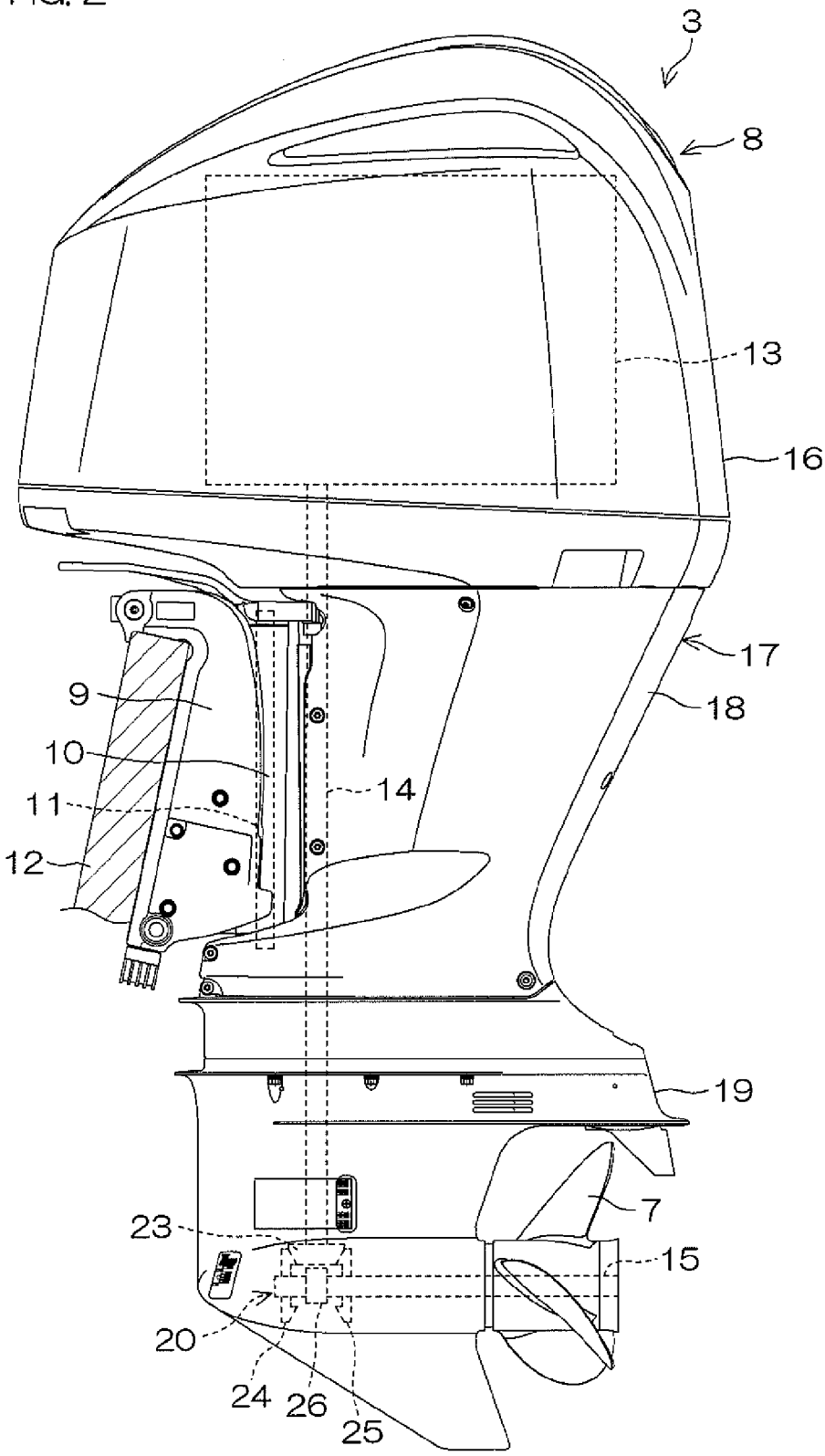
FIG. 2 is a side view of the vessel propulsion apparatus according to the first preferred embodiment of the present invention.

FIG. 2 is a side view of the vessel propulsion apparatus 3 according to the first preferred embodiment of the present invention.

The vessel propulsion apparatus 3 includes an outboard motor 8 that generates a thrust. The vessel propulsion apparatus 3 additionally includes a clamping bracket 9, a swivel bracket 10, and a steering shaft 11. The swivel bracket 10 is connected to the clamping bracket 9. The steering shaft 11 is held by the swivel bracket 10 rotatably around a central axis. The outboard motor 8 is connected to the steering shaft 11. The clamping bracket 9 is attached to a transom 12 provided at the rear portion of the hull 2. Therefore, the outboard motor 8 is attached to the transom 12 via the clamping bracket 9, the swivel bracket 10, and the steering shaft 11. The outboard motor 8 is arranged rotatably around the steering shaft 11 with respect to the clamping bracket 9 and the swivel bracket 10. The outboard motor 8 laterally rotates around the steering shaft 11 while the vessel operator is operating the handle 4. As a result, the vessel 1 is steered.

The outboard motor 8 includes an engine 13 that generates power, a drive shaft 14 that is rotationally driven by the engine 13 in a predetermined direction, and a propeller shaft 15 to which the rotation of the drive shaft 14 is transmitted. The outboard motor 8 additionally includes an engine cover 16 in which the engine 13 is placed, and a casing 17 disposed below the engine cover 16. The casing 17 includes an upper case 18 and a lower case 19 disposed below the upper case 18. The drive shaft 14 extends in a vertical direction inside the upper and lower cases 18 and 19. An upper end portion of the drive shaft 14 is connected to the engine 13. A lower end portion of the drive shaft 14 is connected to the propeller shaft 15 via a gear mechanism 20. The propeller shaft 15 extends in a horizontal direction inside the lower case 19. A rear end portion of the propeller shaft 15 protrudes backwardly from the lower case 19. The propeller 7 is connected to the rear end portion of the propeller shaft 15. The propeller 7 is rotationally driven by the engine 13. The propeller 7 rotates in the normal rotation direction and in the reverse rotation direction together with the propeller shaft 15.

Figure 3:
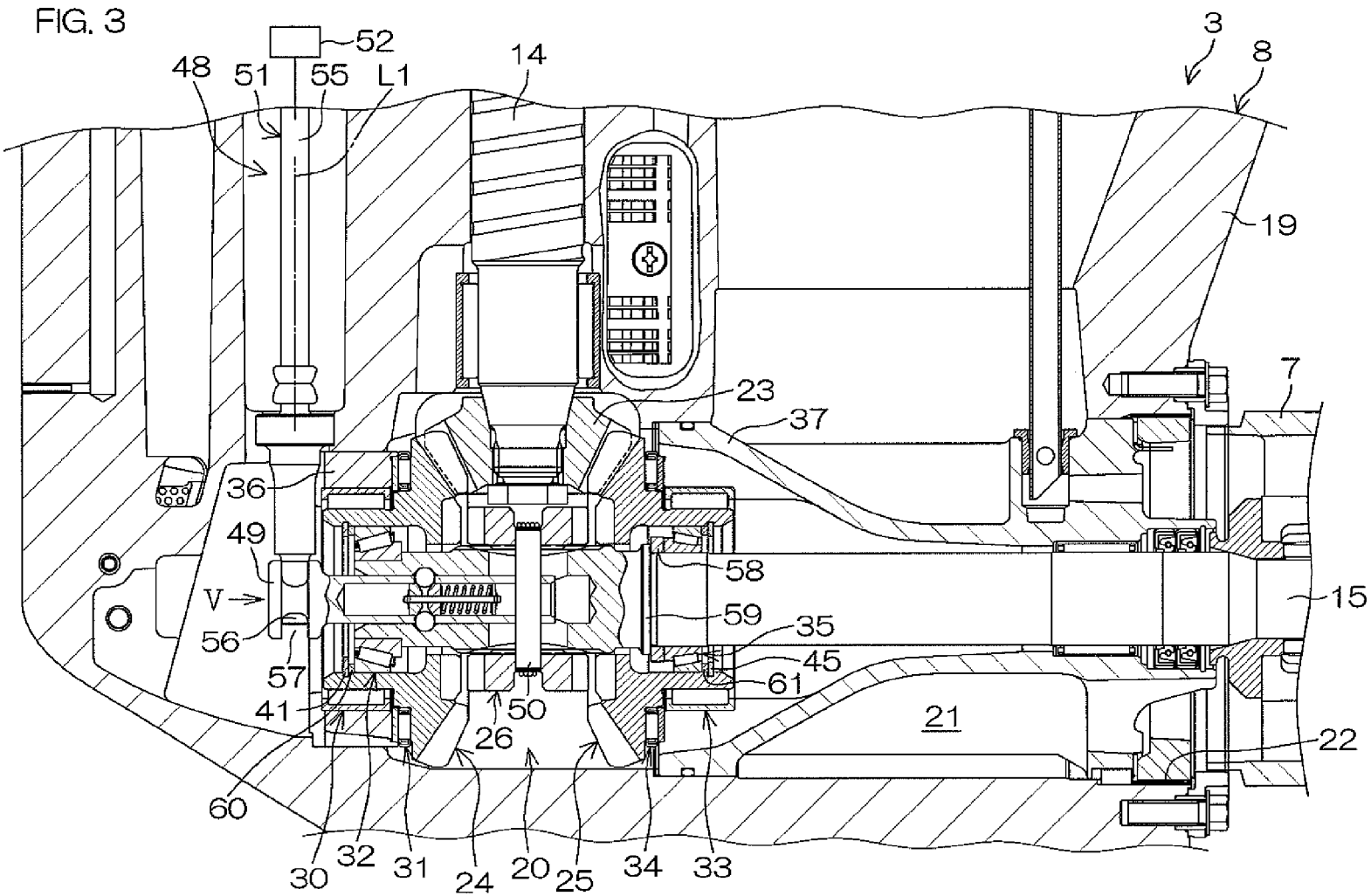
FIG. 3 is a sectional view of a lower unit of the outboard motor according to the first preferred embodiment of the present invention.
Figure 4:
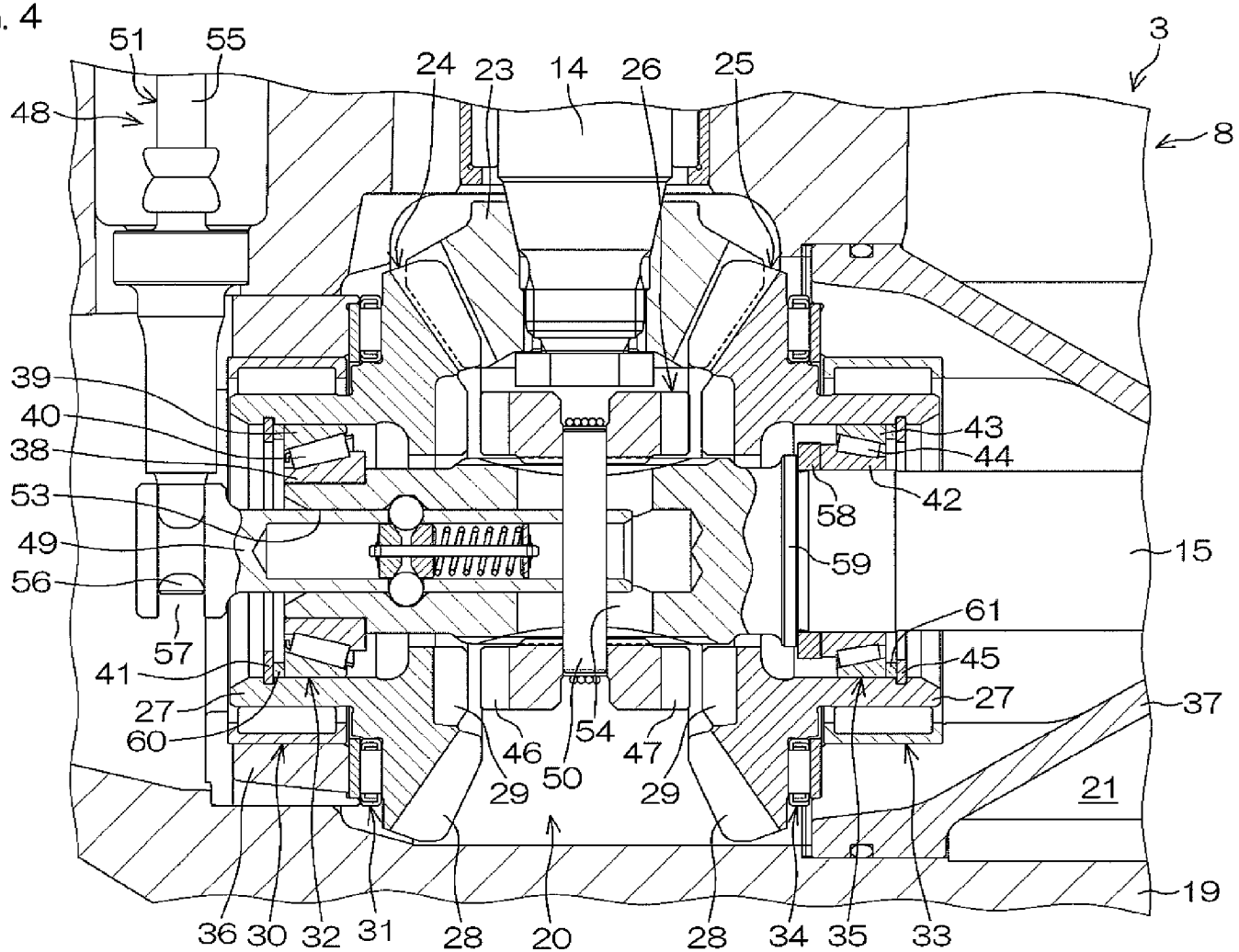
FIG. 4 is an enlarged view of a portion of FIG. 3.
Figure 5:
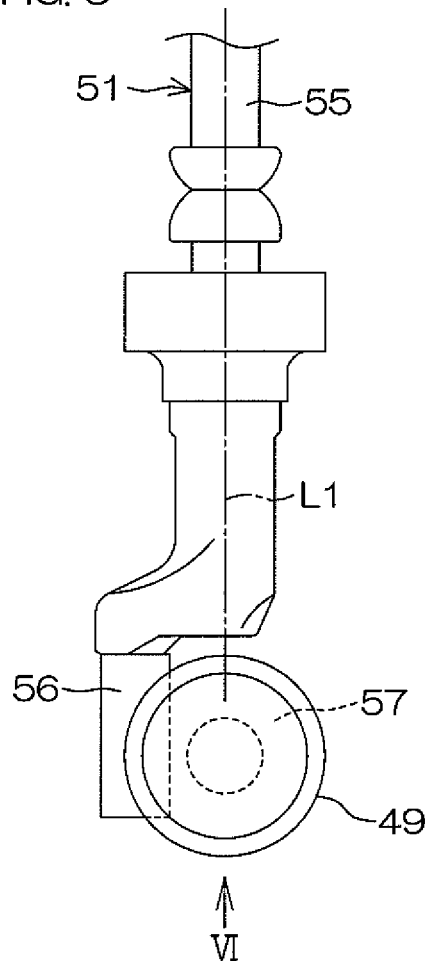
FIG. 5 is a view of a slider and a cam according to the first preferred embodiment of the present invention, viewed from the direction of arrow V of FIG. 3.
Figure 6:
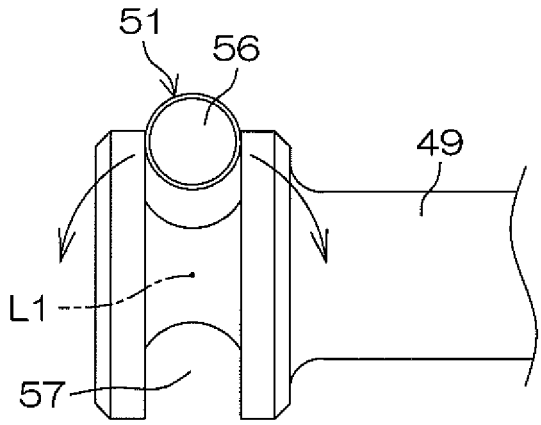
FIG. 6 is a view of the slider and the cam according to the first preferred embodiment of the present invention, viewed from the direction of arrow VI of FIG. 5.

FIG. 3 is a sectional view of a lower unit of the outboard motor 8 according to the first preferred embodiment of the present invention, and FIG. 4 is an enlarged view of a portion of FIG. 3. FIG. 5 is a view of a slider 49 and a cam 51 according to the first preferred embodiment of the present invention, viewed from the direction of arrow V of FIG. 3. FIG. 6 is a view of the slider 49 and the cam 51 according to the first preferred embodiment of the present invention, viewed from the direction of arrow VI of FIG. 5. Hereinafter, reference is made to FIG. 3 and FIG. 4. Reference to FIG. 5 and FIG. 6 is appropriately made if necessary.

The outboard motor 8 includes the gear mechanism 20 that transmits the rotation of the drive shaft 14 to the propeller shaft 15. The gear mechanism 20 is contained in an internal space 21 defined inside the lower case 19. The gear mechanism 20, a housing 37, and so on are built into the internal space 21 from an opening 22 provided in a rear surface of the lower case 19. The gear mechanism 20 includes a pinion 23 connected to the lower end portion of the drive shaft 14, a first gear 24 and a second gear 25 that engage the pinion 23, and a dog clutch 26 that is selectively connected to one of the first and second gears 24 and 25. Each of the pinion 23 and the first and second gears 24 and 25 is, for example, a bevel gear. The first and second gears 24 and 25 face each other in a front-rear direction. The dog clutch 26 is disposed between the first and second gears 24 and 25. Each of the first and second gears 24, 25 and the dog clutch 26 is cylindrical, and the propeller shaft 15 is inserted in the first and second gears 24, 25 and the dog clutch 26. The pinion 23 engages the first and second gears 24 and 25, and therefore, when the pinion 23 rotates, the first and second gears 24 and 25 rotate in mutually opposite directions.

The first and second gears 24 and 25 are, for example, the same type of gear. Therefore, the first and second gears 24 and 25 are the same in shape and in material. Each of the first and second gears 24 and 25 includes a cylindrical portion 27, a cylindrical tooth portion 28 that has an outer diameter greater than the cylindrical portion 27, and a cylindrical engagement portion 29 disposed inside the tooth portion 28. The corresponding cylindrical portion 27, tooth portion 28, and engagement portion 29 are coaxial. The propeller shaft 15 is inserted inside the cylindrical portions 27, the tooth portions 28, and the engagement portions 29 of the first and second gears 24 and 25. The first and second gears 24 and 25 are arranged so as to be relatively rotatable with respect to the propeller shaft 15 and the lower case 19 via a plurality of bearings 30 to 35 provided in the outboard motor 8.

In detail, the outboard motor 8 includes a cylindrical adaptor 36 held by the lower case 19. The cylindrical portion 27 of the first gear 24 is inserted in the adaptor 36 so that the tooth portion 28 of the first gear 24 is located behind the adaptor 36 (i.e., at the right side in FIGS. 3 and 4). A first roller bearing 30 is disposed between the adaptor 36 and the cylindrical portion 27 of the first gear 24, and a first thrust bearing 31 is disposed between the adaptor 36 and the tooth portion 28 of the first gear 24. The first gear 24 is rotatably held by the adaptor 36 via the first roller bearing 30 and the first thrust bearing 31. Therefore, the first gear 24 is relatively rotatable with respect to the lower case 19. A first tapered roller bearing 32 is disposed between the cylindrical portion 27 of the first gear 24 and the propeller shaft 15. The propeller shaft 15 is held by the first gear 24 via the first tapered roller bearing 32. Therefore, the first gear 24 is relatively rotatable with respect to the propeller shaft 15.

The outboard motor 8 additionally includes a cylindrical housing 37 held by the lower case 19. The cylindrical portion 27 of the second gear 25 is inserted in the housing 37 so that the tooth portion 28 of the second gear 25 is located in front of the housing 37 (i.e., at the left side in FIGS. 3 and 4). A second roller bearing 33 is disposed between the housing 37 and the cylindrical portion 27 of the second gear 25, and a second thrust bearing 34 is disposed between the housing 37 and the tooth portion 28 of the second gear 25. The first roller bearing 30 and the second roller bearing 33 preferably are, for example, the same type of bearing, and the first thrust bearing 31 and the second thrust bearing 34 are, for example, the same type of bearing (roller bearings). The second gear 25 is rotatably held by the housing 37 via the second roller bearing 33 and the second thrust bearing 34. Therefore, the second gear 25 is relatively rotatable with respect to the lower case 19. A second tapered roller bearing 35 is disposed between the cylindrical portion 27 of the second gear 25 and the propeller shaft 15. The propeller shaft 15 is held by the second gear 25 via the second tapered roller bearing 35. Therefore, the second gear 25 is relatively rotatable with respect to the propeller shaft 15.

The first tapered roller bearing 32 includes a cylindrical first inner race 38 that surrounds the propeller shaft 15, a cylindrical first outer race 39 that surrounds the first inner race 38, and a plurality of first rollers 40 disposed between the first inner race 38 and the first outer race 39. The first inner race 38 is connected to the propeller shaft 15, and the first outer race 39 is connected to the first gear 24. The first rollers 40 are disposed along a conic surface that tapers toward the front. The first tapered roller bearing 32 is disposed in the first gear 24 (i.e., in the cylindrical portion 27). The first tapered roller bearing 32 is prevented from moving from the inside of the first gear 24 by a first circlip 41 and a washer 60 disposed in the first gear 24.

On the other hand, the second tapered roller bearing 35 includes a cylindrical second inner race 42 that surrounds the propeller shaft 15, a cylindrical second outer race 43 that surrounds the second inner race 42, and a plurality of second rollers 44 disposed between the second inner race 42 and the second outer race 43. The second inner race 42 is connected to the propeller shaft 15, and the second outer race 43 is connected to the second gear 25. The second rollers 44 are disposed along a conic surface that tapers toward the rear. The second tapered roller bearing 35 is disposed in the second gear 25 (i.e., in the cylindrical portion 27). The second tapered roller bearing 35 is prevented from moving from the inside of the second gear 25 by the second circlip 45 and the washer 61 disposed in the second gear 25.

The dog clutch 26 is disposed between the engagement portion 29 of the first gear 24 and the engagement portion 29 of the second gear 25. The dog clutch 26 includes a first engagement portion 46 that faces the engagement portion 29 of the first gear 24 and a second engagement portion 47 that faces the engagement portion 29 of the second gear 25. The dog clutch 26 is connected to the propeller shaft 15 by, for example, a spline. Therefore, the dog clutch 26 rotates together with the propeller shaft 15. Additionally, the dog clutch 26 is movable along the propeller shaft 15 in the axial direction of the propeller shaft 15 (in the front-rear direction). The dog clutch 26 is placed at any shift position of a normal rotation position at which the engagement portion 29 of the first gear 24 engages the first engagement portion 46, a reverse rotation position at which the engagement portion 29 of the second gear 25 engages the second engagement portion 47, and a neutral position at which the dog clutch 26 is spaced away from the first and second gears 24 and 25.

In detail, the outboard motor 8 includes a shift mechanism 48 that switches the shift position of the dog clutch 26. The shift mechanism 48 includes a slider 49 inserted in the front end portion of the propeller shaft 15, a connection pin 50 that connects the slider 49 and the dog clutch 26 together, a cam 51 that moves the slider 49 in the front-rear direction, and a shift actuator 52 that rotates the cam 51. The slider 49 is inserted in an insertion hole 53 provided in the propeller shaft 15. The insertion hole 53 extends backwardly from the front end of the propeller shaft 15 along a central axis of the propeller shaft 15. The slider 49 is movable in the front-rear direction along the insertion hole 53. The front end portion of the slider 49 protrudes forwardly from the front end of the propeller shaft 15, whereas the rear end portion of the slider 49 is disposed in a through-hole 54 provided in the propeller shaft 15. The through-hole 54 perpendicularly or substantially perpendicularly intersects with the insertion hole 53, and penetrates the propeller shaft 15.

The connection pin 50 is connected to the slider 49 at the inside of the propeller shaft 15, i.e., at the intersection of the insertion hole 53 and the through-hole 54. The connection pin 50 perpendicularly intersects with the propeller shaft 15, and both end portions of the connection pin 50 protrude from the propeller shaft 15. Both end portions of the connection pin 50 are connected to the dog clutch 26 between the first engagement portion 46 and the second engagement portion 47. The dog clutch 26 and the slider 49 are connected together so as to be moved as one in the axial direction of the propeller shaft 15 via the connection pin 50. The through-hole 54 is a hole that is long in the axial direction of the propeller shaft 15. The dog clutch 26, the slider 49, and the connection pin 50 are movable in the front-rear direction within the range of the length of the through-hole 54.

The cam 51 includes a rod portion 55 extending in the vertical direction and a pin portion 56. The pin portion 56 protrudes downwardly from the rod portion 55. As shown in FIG. 5, the pin portion 56 is eccentric with respect to the rod portion 55. As shown in FIGS. 5 and 6, the pin portion 56 is inserted in an annular groove 57 provided on the front end portion of the slider 49. The annular groove 57 surrounds the front end portion of the slider 49. The pin portion 56 is inserted in the annular groove 57 at the right or left of the slider 49. When a shift operation to switch the traveling direction of the vessel 1 is performed by the vessel operator, the shift actuator 52 rotates the cam 51 around a central axis L1 of the rod portion 55. The pin portion 56 is eccentric with respect to the rod portion 55, and therefore, as shown in FIG. 6, the pin portion 56 moves in the front-rear direction (in the right-left direction in FIG. 6) while rotating around the central axis L1 of the rod portion 55 in response to the rotation of the cam 51. Therefore, the slider 49 moves in the front-rear direction together with the connection pin 50 and the dog clutch 26 in response to the rotation of the cam 51. In other words, the dog clutch 26 is placed at any of the normal rotation position, the reverse rotation position, and the neutral position by the rotation of the cam 51.

In a state in which the dog clutch 26 is placed at the normal rotation position, the rotation of the drive shaft 14 transmitted to the first gear 24 via the pinion 23 is transmitted to the dog clutch 26 via the engagement portion 29 of the first gear 24 and the first engagement portion 46 of the dog clutch 26. As a result, the propeller shaft 15 and the propeller 7 rotate in the normal rotation direction. On the other hand, in a state in which the dog clutch 26 is placed at the reverse rotation position, the rotation of the drive shaft 14 transmitted to the second gear 25 via the pinion 23 is transmitted to the dog clutch 26 via the engagement portion 29 of the second gear 25 and the second engagement portion 47 of the dog clutch 26. As a result, the propeller shaft 15 and the propeller 7 rotate in the reverse rotation direction. In a state in which the dog clutch 26 is placed at the neutral position (i.e., the position shown in FIGS. 3 and 4), the dog clutch 26 is not connected to either of the first and second gears 24 and 25, and therefore the rotation of the drive shaft 14 is not transmitted to the propeller shaft 15 and the propeller 7, and the first and second gears 24 and 25 rotate idle.

Even in a case in which the vessel propulsion apparatus 3 is used according to either of the normal and reverse rotation specifications, the cam 51 is driven in one rotation direction around the central axis L1 of the rod portion 55 when a forward shift operation to switch the traveling direction of the vessel 1 to the forward traveling is performed by the remote control 5 operated by the vessel operator. Likewise, even in a case in which the vessel propulsion apparatus 3 is used according to either of the normal and reverse rotation specifications, the cam 51 is driven in the other rotation direction (i.e., direction opposite to the one rotation direction) around the central axis L1 of the rod portion 55 when a backward shift operation to switch the traveling direction of the vessel 1 to the backward traveling is performed by the remote control 5 operated by the vessel operator. In other words, the rotation direction of the cam 51 is predetermined for each shift operation in spite of whether the vessel propulsion apparatus 3 is used according to normal or reverse rotation specifications. If the rotation direction of the cam 51 is constant, the moving direction of the slider 49 is inverted between a case in which the pin portion 56 is inserted in the annular groove 57 at the right of the slider 49 and a case in which the pin portion 56 is inserted in the annular groove 57 at the left of the slider 49. Therefore, the direction in which the slider 49 moves when a shift operation is performed is set according to the insertion position of the pin portion 56 with respect to the annular groove 57.

In a case in which the vessel propulsion apparatus 3 is used according to normal rotation specifications, the pin portion 56 is inserted in the annular groove 57 at the position at which the slider 49 moves forwardly when a forward shift operation is performed. On the other hand, in a case in which the vessel propulsion apparatus 3 is used according to reverse rotation specifications, the pin portion 56 is inserted in the annular groove 57 at the position at which the slider 49 moves backwardly when a forward shift operation is performed. In other words, in a case in which the vessel propulsion apparatus 3 is used according to reverse rotation specifications, the pin portion 56 is inserted in the annular groove 57 at the position opposite to that of a case in which the vessel propulsion apparatus 3 is used according to normal rotation specifications. The specifications of the vessel propulsion apparatus 3 are set according to a method of assembling the vessel propulsion apparatus 3 as mentioned above (i.e., according to a direction in which the cam 51 is fitted), and therefore, even if the vessel propulsion apparatus 3 is used according to either of the specifications, the vessel operator can switch the traveling direction of the vessel 1 to the forward traveling by the same operation, and can switch the traveling direction thereof to the backward traveling by the same operation.

Figure 7:
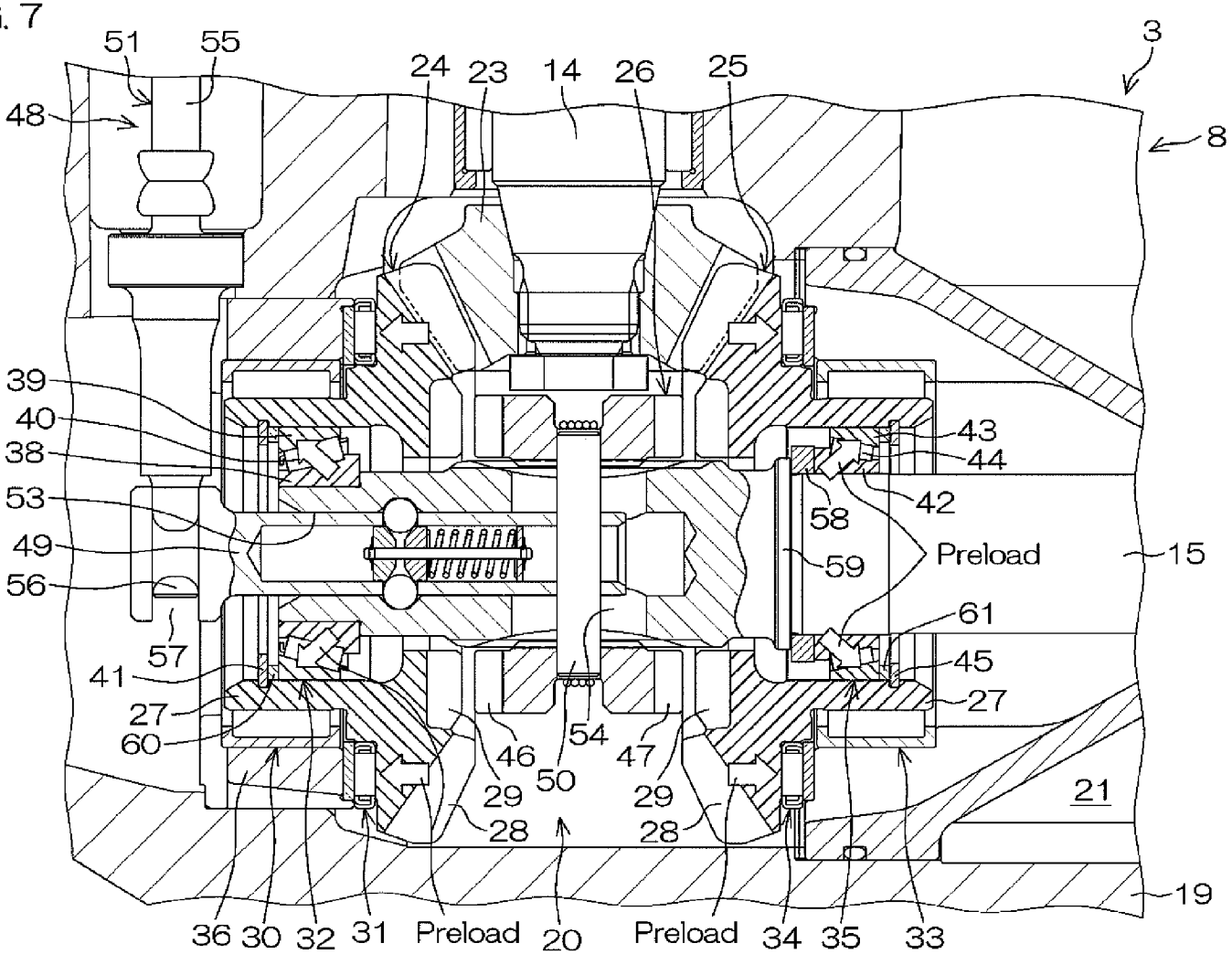
FIG. 7 is a view for describing a preload applied onto the first tapered roller bearing and onto the second tapered roller bearing according to the first preferred embodiment of the present invention.

FIG. 7 is a view for describing a preload applied onto the first tapered roller bearing 32 and onto the second tapered roller bearing 35 according to the first preferred embodiment of the present invention.

The outboard motor 8 includes an adjusting member 58 arranged to apply a preload onto the first tapered roller bearing 32 and onto the second tapered roller bearing 35. The adjusting member 58 is disposed between the second gear 25 and the propeller shaft 15. The adjusting member 58 is, for example, annular. The adjusting member 58 includes, for example, a washer. The adjusting member 58 may include a plurality of members (e.g., a shim and a washer). The adjusting member 58 may be integrally provided with the propeller shaft or with the tapered roller bearing, for example, by molding. The adjusting member 58 surrounds the propeller shaft 15. The propeller shaft 15 includes an annular flange 59 disposed between the first tapered roller bearing 32 and the second tapered roller bearing 35. The flange 59 protrudes outwardly from the propeller shaft 15, and extends in a circumferential direction of the propeller shaft 15 over the whole circumference. The flange 59 is disposed between the dog clutch 26 and the second tapered roller bearing 35. The adjusting member 58 is disposed between the flange 59 and the second tapered roller bearing 35. The adjusting member 58 is in contact with the flange 59 and with the second tapered roller bearing 35. The adjusting member 58 and the flange 59 are disposed inside the second gear 25. A member having a thickness slightly greater than the gap between the flange 59 and the second tapered roller bearing 35 is used as the adjusting member 58 in order to apply a preload. The adjusting member 58 is preferably made of, for example, carbon tool steel.

The adjusting member 58 is disposed between the second inner race 42 and the flange 59, and therefore the propeller shaft 15 is disposed more forwardly with respect to the second tapered roller bearing 35 than in a case in which the adjusting member 58 is not disposed. Therefore, the first inner race 38 is pushed forwardly by the propeller shaft 15, and a preload is applied onto the first tapered roller bearing 32 (see the white arrow). Additionally, the first inner race 38 is pushed forwardly, and, as a result, the first gear 24 holding the first tapered roller bearing 32 is pushed forwardly, and the tooth portion 28 of the first gear 24 is pressed against the first thrust bearing 31. An internal gap of the first tapered roller bearing 32 is removed by a preload onto the first tapered roller bearing 32, and the first tapered roller bearing 32 is restrained from being inclined and being moved in the axial direction. In other words, a preload applied onto the first tapered roller bearing 32 restrains the displacement of the first tapered roller bearing 32 and the first gear 24.

On the other hand, the propeller shaft 15 pushes the first tapered roller bearing 32 forwardly, and, as a result, a backward reaction force is applied to the propeller shaft 15, and is then transmitted to the second inner race 42 via the flange 59 and the adjusting member 58. As a result, the second inner race 42 is pushed backwardly, and a preload is applied onto the second tapered roller bearing 35 (see the white arrow). Additionally, the second inner race 42 is pushed backwardly, and, as a result, the second gear 25 holding the second tapered roller bearing 35 is pushed backwardly, and the tooth portion 28 of the second gear 25 is pressed against the second thrust bearing 34. An internal gap of the second tapered roller bearing 35 is removed by the preload onto the second tapered roller bearing 35, and the second tapered roller bearing 35 is restrained from being inclined and being moved in the axial direction. In other words, the preload onto the second tapered roller bearing 35 makes it possible to restrain the second tapered roller bearing 35 and the second gear 25 from being displaced.

Next, a description will be given of a case in which the vessel propulsion apparatus 3 is used according to normal rotation specifications and a case in which the vessel propulsion apparatus 3 is used according to reverse rotation specifications.

Figure 8:
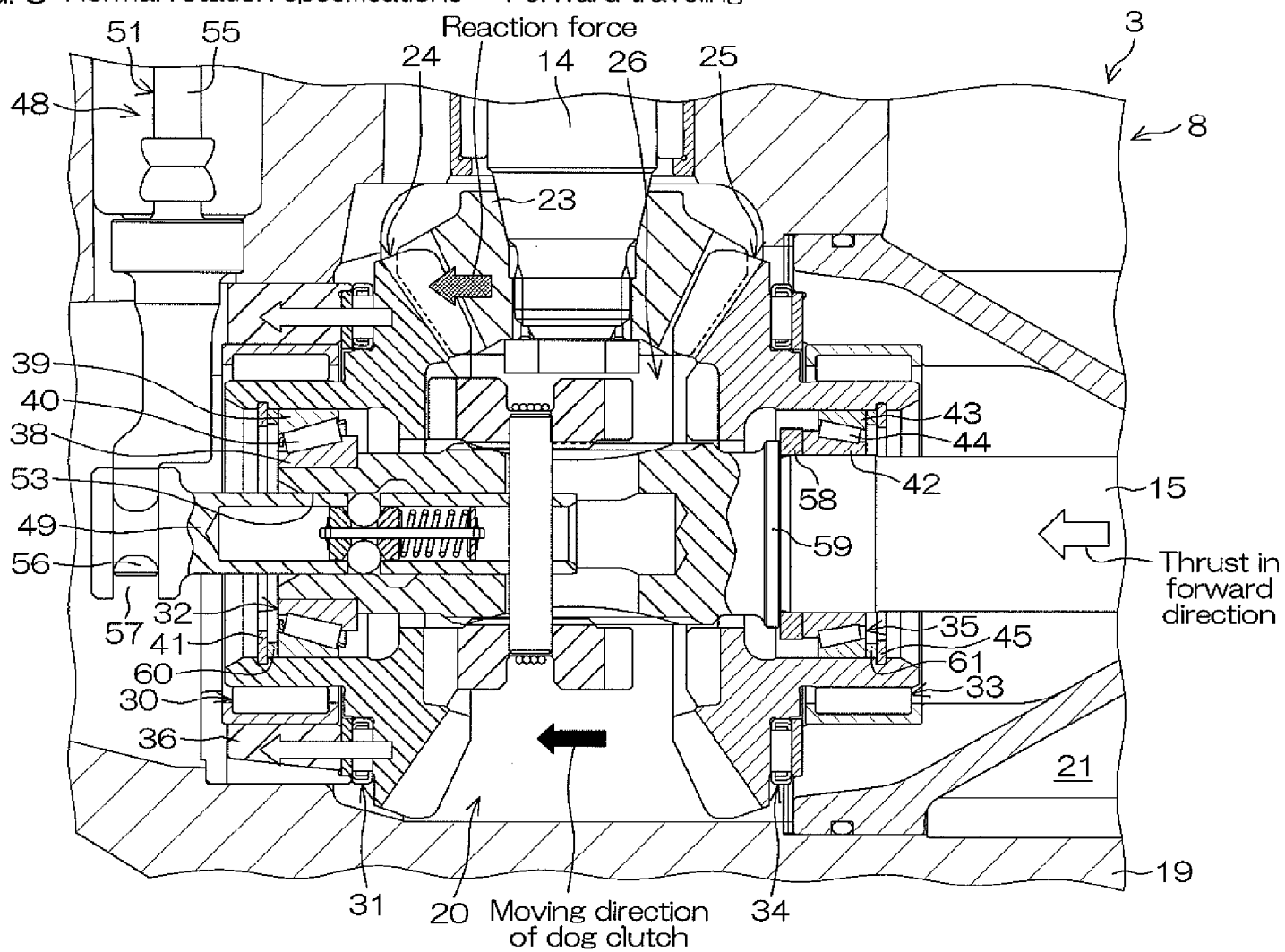
FIG. 8 is a sectional view of the lower unit of the outboard motor according to the first preferred embodiment of the present invention.
Figure 9:
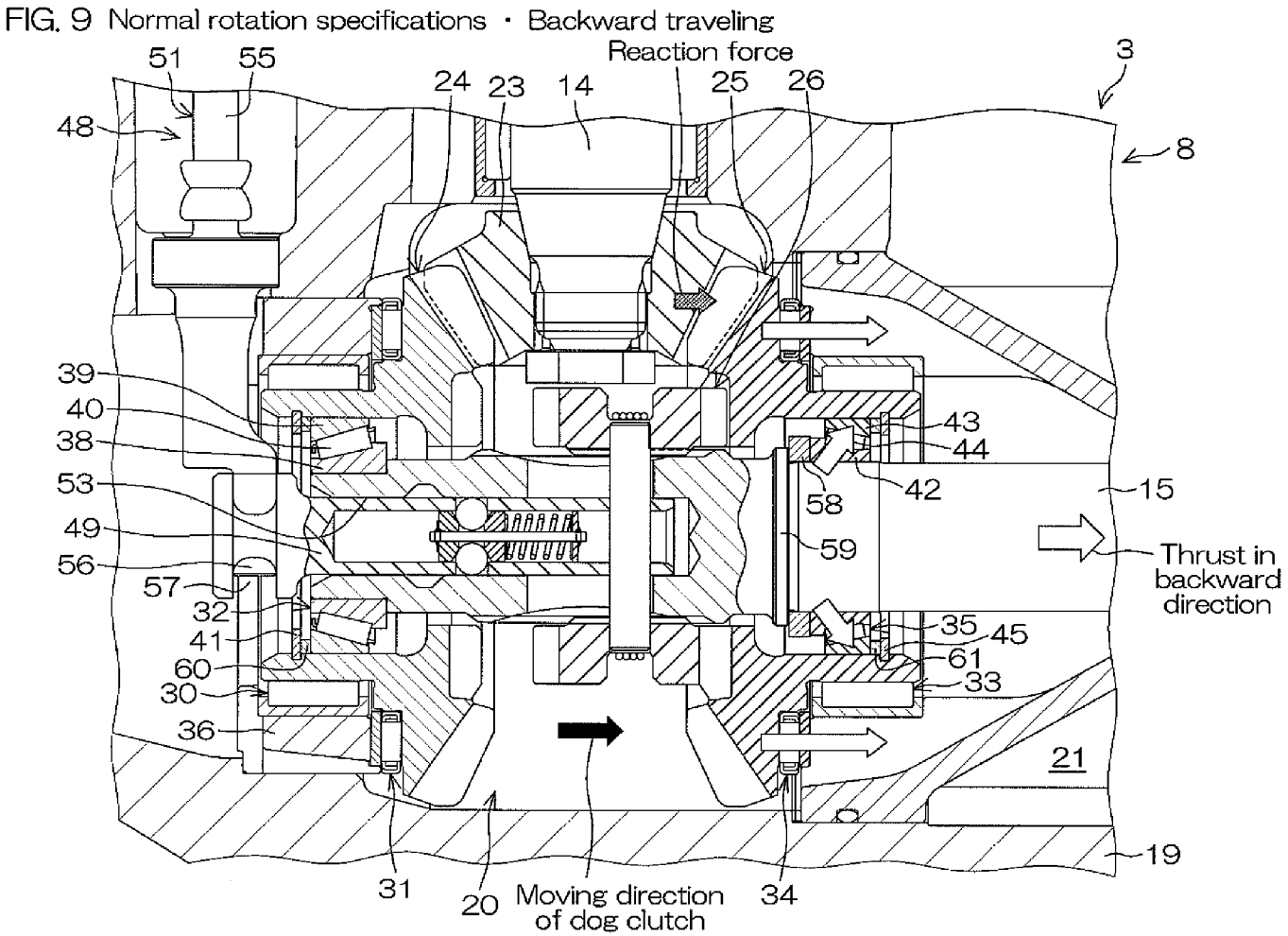
FIG. 9 is a sectional view of the lower unit of the outboard motor according to the first preferred embodiment of the present invention.
Figure 10:
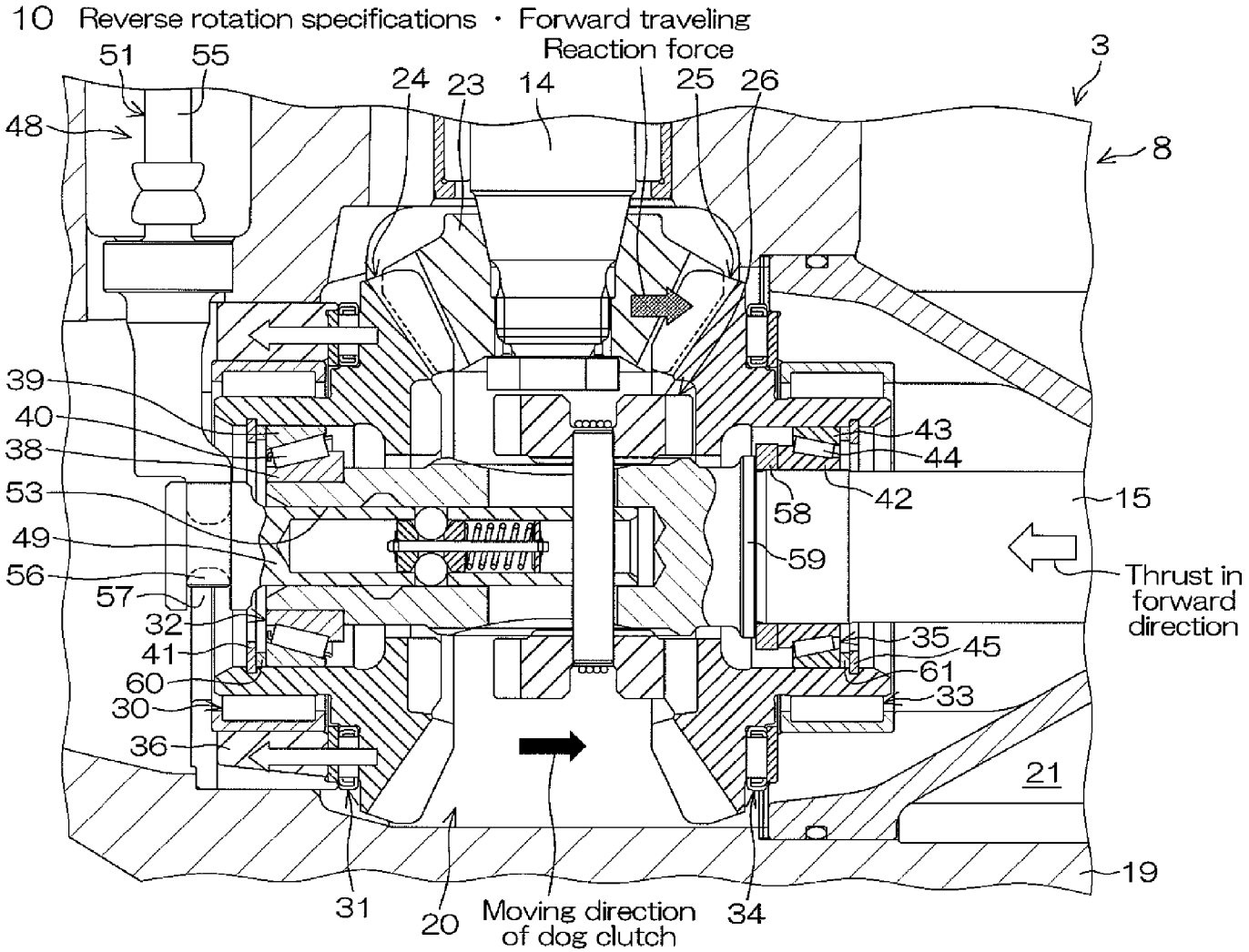
FIG. 10 is a sectional view of the lower unit of the outboard motor according to the first preferred embodiment of the present invention.

FIGS. 8 to 11 are sectional views of the lower unit of the outboard motor 8 according to the first preferred embodiment of the present invention. The vessel propulsion apparatus 3 shown in FIGS. 8 and 9 is set at normal rotation specifications, whereas the vessel propulsion apparatus 3 shown in FIGS. 10 and 11 is set at reverse rotation specifications. In detail, the pin portion 56 is inserted in the annular groove 57 at the right of the slider 49 (i.e., innermost side of the figure sheet) in FIGS. 8 and 9, whereas the pin portion 56 is inserted in the annular groove 57 at the left of the slider 49 (i.e., near side of the figure sheet) in FIGS. 10 and 11.

As shown in FIG. 8, when the vessel propulsion apparatus 3 set at normal rotation specifications generates a thrust in the forward direction, the dog clutch 26 is engaged with the first gear 24 serving as a forward gear (see the black arrow). As a result, the rotation of the drive shaft 14 is transmitted to the dog clutch 26 via the pinion 23 and the first gear 24, and the normal-rotation propeller 7*a* (see FIG. 1) rotates in the normal rotation direction together with the dog clutch 26 and the propeller shaft 15. A thrust in the forward direction generated by the rotation in the normal rotation direction of the propeller 7 is transmitted to the propeller shaft 15, the first tapered roller bearing 32, the washer 60, the circlip 41, the first gear 24, the first thrust bearing 31, the adaptor 36, and the lower case 19 in this order (see the white arrow). On the other hand, a reaction force caused by the transmission of power from the pinion 23 to the first gear 24 is applied to the first gear 24 at an engagement position of the pinion 23 and the first gear 24 (see the crosshatched arrow). In other words, a force by which the first gear 24 is inclined is applied to the first gear 24. However, a thrust in the forward direction is applied to the first tapered roller bearing 32, and, in addition, a preload is applied onto the first tapered roller bearing 32 and the first gear, and therefore the position of the first gear 24 is fixed. Therefore, the amount of inclination of the first gear 24 is minimized. Therefore, the engagement between the pinion 23 and the first gear 24 becomes stable, and a force greater than a designed, assumed value is prevented from being applied to the first gear 24.

As shown in FIG. 9, when the vessel propulsion apparatus 3 set at normal rotation specifications generates a thrust in the backward direction, the dog clutch 26 is engaged with the second gear 25 serving as a reverse gear (see the black arrow). As a result, the rotation of the drive shaft 14 is transmitted to the dog clutch 26 via the pinion 23 and the second gear 25, and the normal-rotation propeller 7*a* (see FIG. 1) rotates in the reverse rotation direction together with the dog clutch 26 and the propeller shaft 15. A thrust in the backward direction generated by the rotation in the reverse rotation direction of the propeller 7 is transmitted to the propeller shaft 15, the adjusting member 58, the second tapered roller bearing 35, the washer 61, the circlip 45, the second gear 25, the second thrust bearing 34, the housing 37, and the lower case 19 in this order (see the white arrow). On the other hand, a reaction force caused by the transmission of the rotation from the pinion 23 to the second gear 25 is applied to the second gear 25 at an engagement position of the pinion 23 and the second gear 25 (see the crosshatched arrow). However, when the vessel travels backwardly, torque transmitted from the pinion 23 to the second gear 25 is smaller than when the vessel travels forwardly, and therefore a reaction force applied to the second gear 25, which is caused by the transmission of power from the pinion 23 to the second gear 25, is also smaller. Additionally, a preload is applied onto the second tapered roller bearing 35 and the second gear 25. Therefore, the amount of inclination of the second gear 25 is smaller than when the vessel travels forwardly.

As shown in FIG. 10, when the vessel propulsion apparatus 3 set at reverse rotation specifications generates a thrust in the forward direction, the dog clutch 26 is engaged with the second gear 25 serving as a forward gear (see the black arrow). As a result, the rotation of the drive shaft 14 is transmitted to the dog clutch 26 via the pinion 23 and the second gear 25, and the reverse-rotation propeller 7*b* (see FIG. 1) rotates in the reverse rotation direction together with the dog clutch 26 and the propeller shaft 15. A thrust in the forward direction generated by the rotation in the reverse rotation direction of the propeller 7 is transmitted to the propeller shaft 15, the first tapered roller bearing 32, the washer 60, the circlip 41, the first gear 24, the first thrust bearing 31, the adaptor 36, and the lower case 19 in this order (see the white arrow). On the other hand, a reaction force caused by the transmission of power from the pinion 23 to the second gear 25 is applied to the second gear 25 (see the crosshatched arrow). As a result, a force by which the second gear 25 is inclined is applied to the second gear 25. However, a preload is applied onto the second tapered roller bearing 35 and the second gear 25, and therefore the amount of inclination of the second gear 25 is restrained even if the reaction force is applied to the second gear 25. Therefore, the engagement between the pinion 23 and the second gear 25 becomes stable, and a force greater than a designed, assumed value is prevented from being applied to the second gear 25.

As shown in FIG. 11, when the vessel propulsion apparatus 3 set at reverse rotation specifications generates a thrust in the backward direction, the dog clutch 26 is engaged with the first gear 24 serving as a reverse gear (see the black arrow). As a result, the rotation of the drive shaft 14 is transmitted to the dog clutch 26 via the pinion 23 and the first gear 24, and the reverse-rotation propeller 7*b* (see FIG. 1) rotates in the normal rotation direction together with the dog clutch 26 and the propeller shaft 15. A thrust in the backward direction generated by the rotation in the normal rotation direction of the propeller 7 is transmitted to the propeller shaft 15, the adjusting member 58, the second tapered roller bearing 35, the washer 61, the circlip 45, the second gear 25, the second thrust bearing 34, the housing 37, and the lower case 19 in this order (see the white arrow). On the other hand, a reaction force caused by the transmission of power from the pinion 23 to the first gear 24 is applied to the first gear 24 at an engagement position of the pinion 23 and the first gear 24 (see the crosshatched arrow). However, a preload is applied onto the first tapered roller bearing 32 and the first gear 24, and the reaction force applied to the first gear 24 when the vessel travels backwardly is small, and therefore the amount of inclination of the first gear 24 is smaller than when the vessel travels forwardly.

As described above, in the first preferred embodiment, the adjusting member 58 is arranged to apply a preload onto the first and second tapered roller bearings 32 and 35, and the first gear 24 is pressed forwardly whereas the second gear 25 is pressed downwardly. As a result, an internal gap of the first tapered roller bearing 32 and that of the second tapered roller bearing 35 are removed, and the position of each of the first and second gears 24 and 25 is fixed. In other words, the first and second gears 24 and 25 are held so as not to perform an operation other than rotation. Therefore, the engagement between the pinion 23 and each gear (i.e., each of the first and second gears 24 and 25) can be prevented from becoming unstable even when the vessel propulsion apparatus 3 is used according to either normal or reverse rotation specifications. This makes it possible to prevent the durability of the gears (i.e., the pinion 23, the first gear 24, and the second gear 25) from being decreased. Therefore, the vessel propulsion apparatus 3 can be used according to either normal or reverse rotation specifications.

The position of each of the first and second gears 24 and 25 can be fixed, and the vessel propulsion apparatus 3 can be used according to either normal or reverse rotation specifications as described above, and therefore there is no need to provide special or unique components exclusively for each of the normal and reverse rotation specifications. Therefore, it is possible to reduce the production costs and the number of development man-hours of the vessel propulsion apparatus 3. Additionally, the retail outlet of the vessel propulsion apparatus 3 has no need to stock special or unique components as spare components used for repairs for each of the normal and reverse rotation specifications. Still additionally, the first tapered roller bearing 32, the second tapered roller bearing 35, the first gear 24, and the second gear 25 can remove their backlashes by applying a preload onto the first and second tapered roller bearings 32 and 35, and therefore it is possible to prevent the occurrence of an abnormal noise caused by these backlashes.

Additionally, the vessel 1 usually travels forwardly more often than backwardly. Therefore, in the vessel propulsion apparatus 3 used according to normal rotation specifications, the number of times of use of the first gear 24 serving as a forward gear (e.g., the number of times of connection to the dog clutch 26) is greater than the number of times of use of the second gear 25 serving as a reverse gear. On the other hand, in the vessel propulsion apparatus 3 used according to reverse rotation specifications, the number of times of use of the second gear 25 serving as a forward gear is greater than the number of times of use of the first gear 24 serving as a reverse gear. Therefore, the first gear 24 is more easily worn out than the second gear 25 in the vessel propulsion apparatus 3 used according to normal rotation specifications, whereas the second gear 25 is more easily worn out than the first gear 24 in the vessel propulsion apparatus 3 used according to reverse rotation specifications.

Thus, in the vessel propulsion apparatus 3, the gear (one of the first and second gears 24 and 25) used as a forward gear is worn out more easily. Therefore, if the two first gears 24 are replaced with each other between the two vessel propulsion apparatuses 3 used according to the mutually different specifications and if the two second gears 25 are replaced with each other therebetween, the gear used as a forward gear is used as a reverse gear, and the gear used as a reverse gear is used as a forward gear. As a result, the first and second gears 24 and 25 can be used and worn evenly, and therefore the product life of the vessel propulsion apparatus 3 can be lengthened. Additionally, if the same vessel propulsion apparatus 3 is used according to one of the two different kinds of specifications and is then used according to the other one, the first and second gears 24 and 25 can be used and worn evenly. Therefore, the product life of the vessel propulsion apparatus 3 can be lengthened.

Additionally, in the first preferred embodiment, the lower case 19 defines the internal space 21 in which the gear mechanism 20 is contained and the opening 22 connected to the internal space 21. The gear mechanism 20 and the housing 37 are built into the internal space 21 from the opening 22. The second gear 25 is disposed between the opening 22 and the first gear 24. In other words, the second gear 25 is disposed closer to the opening 22 than the first gear 24. In the production process of the vessel propulsion apparatus 3, there is a possibility that the adjusting member 58 that has already been built in the lower case 19 will be detached and replaced with another adjusting member 58 having a different thickness, for example, when the vessel propulsion apparatus 3 does not satisfy a predetermined performance. For example, when the adjusting member 58 is disposed between the first gear 24 and the propeller shaft 15, there is a need to detach a plurality of components including the housing 37, the second gear 25, and the pinion 23 from the lower case 19 through the opening 22 in order to change the adjusting member 58. On the other hand, the second gear 25 is disposed closer to the opening 22 than the first gear 24, and therefore the number of components to be detached from the lower case 19 in order to change the adjusting member 58 is small when the adjusting member 58 is disposed between the second gear 25 and the propeller shaft 15. Therefore, the number of man-hours relative to the change of the adjusting member 58 can be decreased by disposing the adjusting member 58 between the second gear 25 and the propeller shaft 15.

Additionally, in the first preferred embodiment, the first and second gears 24 and 25 preferably are the same type of gear, and are the same in shape. Therefore, the kinds of components used in the vessel propulsion apparatus 3 can be decreased. As a result, the production costs and the number of development man-hours of the vessel propulsion apparatus 3 can be reduced. Additionally, the first and second gears 24 and 25 are the same in shape, and therefore the first and second gears 24 and 25 can be used and worn evenly by replacing the first and second gears 24 and 25 with each other in the same vessel propulsion apparatus 3 after this vessel propulsion apparatus 3 has been used during a fixed period of time. As a result, the product life of the vessel propulsion apparatus 3 can be lengthened.

Other Preferred Embodiments

Although the first preferred embodiment of the present invention has been described above, the present invention is not limited to the contents of the first preferred embodiment, and can be variously modified within the scope of the appended claims.

For example, in the first preferred embodiment, the vessel 1 is preferably provided with the two vessel propulsion apparatuses 3 as described above. However, the number of vessel propulsion apparatuses 3 of the vessel 1 is not limited to two, and may be one or may be three or more.

Additionally, in the first preferred embodiment, the adjusting member 58 is preferably disposed between the second gear 25 and the propeller shaft 15 as described above. However, the adjusting member 58 may be disposed between the first gear 24 and the propeller shaft 15.

Additionally, in the first preferred embodiment, the first and second gears 24 and 25 preferably are the same in shape as described above. However, the first and second gears 24 and 25 may have mutually different shapes.

Additionally, in the first preferred embodiment, each of the pinion 23, the first gear 24, and the second gear 25 preferably is a bevel gear as described above. However, the pinion 23 may be a gear other than the bevel gear. The same applies to the first and second gears 24 and 25.

Additionally, as described above, in the first preferred embodiment, the first and second roller bearings 30 and 33 preferably are the same type of bearing, whereas the first and second thrust bearings 31 and 34 are the same type of bearing. However, the first and second roller bearings 30 and 33 may have mutually different shapes. The same applies to the first and second thrust bearings 31 and 34.

Additionally, in the first preferred embodiment, each of the first bearing (the first tapered roller bearing 32) supporting the first gear 24 and the second bearing (the second tapered roller bearing 35) supporting the second gear 25 preferably is a tapered roller bearing as described above. However, without being limited to the tapered roller bearing, each of the bearings 32 and 35 may be another type of bearing such as a ball bearing. The same applies to the bearings 30, 31, 33, and 34 other than the bearings 32 and 35.

Additionally, in the first preferred embodiment, the vessel propulsion apparatus 3 preferably includes the outboard motor 8 as described above. However, the vessel propulsion apparatus 3 may be an inboard-outboard motor. In other words, the vessel propulsion apparatus 3 may be arranged to include an engine disposed inside the vessel and a propulsion unit disposed outside the vessel and to generate a thrust by driving the propulsion unit via the engine. If so, the first and second gears 24 and 25 may be arranged to be disposed in the propulsion unit, and the adjusting member 58 may be arranged to apply a preload onto the first bearing supporting the first gear 24 and onto the second bearing supporting the second gear 25.

Additionally, in the first preferred embodiment, the insertion position of the pin portion 56 with respect to the annular groove 57 is preferably changed by whether the vessel propulsion apparatus 3 is used according to normal or reverse rotation specifications as described above (see FIG. 3). However, the insertion position of the pin portion 56 with respect to the annular groove 57 may be fixed, and the rotation direction of the cam 51 by the shift actuator 52 (see FIG. 3) may be changed by whether the vessel propulsion apparatus 3 is used according to normal or reverse rotation specifications. In other words, in Drive-By-Wire (DBW), the specifications of the vessel propulsion apparatus 3 may be changed by controlling a direction in which the shift actuator 52 (electric actuator) is operated.

In detail, if the rotation direction of the cam 51 is fixed, the moving direction of the dog clutch 26 is changed by the insertion position of the pin portion 56 with respect to the annular groove 57. On the other hand, the moving direction of the dog clutch 26 is reversed if the rotation direction of the cam 51 is reversed even when the insertion position of the pin portion 56 with respect to the annular groove 57 is fixed. Therefore, the specifications of the vessel propulsion apparatus 3 may be set by the rotation direction of the cam 51 by the shift actuator 52. In other words, when the vessel propulsion apparatus 3 is used according to reverse rotation specifications, the cam 51 may be rotationally driven in a direction opposite to the direction given when the vessel propulsion apparatus 3 is used according to normal rotation specifications. If so, a method of assembling the vessel propulsion apparatus 3 (i.e., a direction in which the cam 51 is fitted) is not necessarily required to be changed for each of the normal and reverse rotation specifications.

The present application corresponds to Japanese Patent Application No. 2011-051668 filed on Mar. 9, 2011 in the Japan Patent Office, the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

a first shaft that is rotationally driven;

a drive gear connected to the first shaft;

a tubular first driven gear that engages the drive gear;

a tubular second driven gear that engages the drive gear;

a dog clutch that is switched by a shift operation between a connected state in which the dog clutch is connected to one of the first driven gear and the second driven gear and a non-connected state in which the dog clutch is not connected to either of the first driven gear and the second driven gear;

a second shaft that is inserted in the first driven gear and in the second driven gear, that is connected to the dog clutch, and that is arranged to undergo a thrust;

a first bearing disposed between the first driven gear and the second shaft;

a second bearing disposed between the second driven gear and the second shaft;

a case that contains the drive gear, the first driven gear, the second driven gear, the dog clutch, the first bearing, and the second bearing and to which a thrust applied to the second shaft is transmitted via the first bearing and the first driven gear or via the second bearing and the second driven gear; and an adjusting member that is disposed between the second shaft and at least one of the first driven gear and the second driven gear, and that is arranged to apply a preload onto the first bearing and onto the second bearing.

2. The vessel propulsion apparatus according to claim 1, wherein the first bearing includes a first inner race connected to the second shaft and a first outer race connected to the first driven gear, and the second bearing includes a second inner race connected to the second shaft and a second outer race connected to the second driven gear.

3. The vessel propulsion apparatus according to claim 1, wherein the adjusting member is disposed between the first bearing and the second bearing.

4. The vessel propulsion apparatus according to claim 3, wherein the second shaft includes a flange disposed between the first bearing and the second bearing, and the adjusting member is disposed between the flange and one of the first bearing and the second bearing.

5. The vessel propulsion apparatus according to claim 1, wherein the case defines an internal space in which the first driven gear and the second driven gear are contained and an opening connected to the internal space, and the second driven gear is disposed between the opening and the first driven gear, and the adjusting member is disposed between the second driven gear and the second shaft.

6. The vessel propulsion apparatus according to claim 1, wherein the first driven gear and the second driven gear are the same in shape.

7. The vessel propulsion apparatus according to claim 1, wherein each of the drive gear, the first driven gear, and the second driven gear includes a bevel gear.

8. The vessel propulsion apparatus according to claim 1, wherein each of the first bearing and the second bearing includes a tapered roller bearing.

9. The vessel propulsion apparatus according to claim 1, wherein the first shaft includes a drive shaft that extends in a vertical direction, and the second shaft includes a propeller shaft that extends in a horizontal direction.

10. The vessel propulsion apparatus according to claim 1, further comprising:

a third bearing disposed between the first driven gear and the case; and a fourth bearing disposed between the second driven gear and the case.

11. A vessel propulsion apparatus comprising:

a first shaft that is rotationally driven;

a drive gear connected to the first shaft;

a tubular first driven gear that engages the drive gear and is pressed forwardly;

a tubular second driven gear that engages the drive gear and is pressed backwardly;

a dog clutch that is switched by a shift operation between a connected state in which the dog clutch is connected to one of the first driven gear and the second driven gear and a non-connected state in which the dog clutch is not connected to either of the first driven gear and the second driven gear;

a second shaft that is inserted in the first driven gear and in the second driven gear, that is connected to the dog clutch, and that is arranged to undergo a thrust;

a first bearing disposed between the first driven gear and the second shaft;

a second bearing disposed between the second driven gear and the second shaft; and a case that contains the drive gear, the first driven gear, the second driven gear, the dog clutch, the first bearing, and the second bearing and to which a thrust applied to the second shaft is transmitted via the first bearing and the first driven gear or via the second bearing and the second driven gear.

12. A vessel propulsion apparatus comprising:

a first shaft that is rotationally driven;

a drive gear connected to the first shaft;

a tubular first driven gear that engages the drive gear;

a tubular second driven gear that engages the drive gear;

a dog clutch that is switched by a shift operation between a connected state in which the dog clutch is connected to one of the first driven gear and the second driven gear and a non-connected state in which the dog clutch is not connected to either of the first driven gear and the second driven gear;

a second shaft that is inserted in the first driven gear and in the second driven gear, that is connected to the dog clutch, and that is arranged to undergo a thrust;

a first bearing disposed between the first driven gear and the second shaft;

a second bearing disposed between the second driven gear and the second shaft;

a case that contains the drive gear, the first driven gear, the second driven gear, the dog clutch, the first bearing, and the second bearing and to which a thrust applied to the second shaft is transmitted via the first bearing and the first driven gear or via the second bearing and the second driven gear; and an adjusting member that is disposed between the second driven gear and the second shaft, and that is arranged to apply a preload onto the first bearing and onto the second bearing; wherein the second shaft includes a flange disposed between the dog clutch and the second bearing; and the adjusting member is disposed between the flange and the second bearing.

* * * * *